US011754968B2

(12) United States Patent
Oguni et al.

(10) Patent No.: US 11,754,968 B2
(45) Date of Patent: Sep. 12, 2023

(54) IMAGE FORMING APPARATUS

(71) Applicant: CANON KABUSHIKI KAISHA, Tokyo (JP)

(72) Inventors: Atsushi Oguni, Kanagawa (JP); Shuntaro Tezuka, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/968,233

(22) Filed: Oct. 18, 2022

(65) Prior Publication Data

US 2023/0131306 A1 Apr. 27, 2023

(30) Foreign Application Priority Data

Oct. 21, 2021 (JP) ..... 2021-172251

(51) Int. Cl.
*G03G 15/00* (2006.01)
*G03G 21/18* (2006.01)
*G03G 15/16* (2006.01)

(52) U.S. Cl.
CPC ..... *G03G 21/1814* (2013.01); *G03G 15/1685* (2013.01); *G03G 21/1842* (2013.01); *G03G 2221/1884* (2013.01)

(58) Field of Classification Search
CPC ..... G03G 15/1685; G03G 21/1814; G03G 21/1817; G03G 21/1821; G03G 21/1825; G03G 21/1839; G03G 21/1842; G03G 21/1864; G03G 21/1871; G03G 2221/1884
See application file for complete search history.

(56) References Cited

U.S. PATENT DOCUMENTS 9,915,915 B2 * 3/2018 Yokoi ..... G03G 21/12
10,248,078 B2 * 4/2019 Sato ..... G03G 21/1814

FOREIGN PATENT DOCUMENTS

JP H10254328 A 9/1998
JP 2005242213 A 9/2005
JP 2015194563 A 11/2015
JP 2019015978 A 1/2019

* cited by examiner

*Primary Examiner* — Hoang X Ngo
(74) *Attorney, Agent, or Firm* — ROSSI, KIMMS & McDOWELL LLP

(57) ABSTRACT

An image forming apparatus includes a photosensitive drum and an apparatus main body, the apparatus main body includes a transfer roller exerting a transfer pressing force on the photosensitive drum, a positioning portion positioning the photosensitive drum in first and second directions by being contacted by a bearing portion holding a rotation axis of the photosensitive drum, the first direction being in a virtual plane perpendicular to the rotation axis, and the second direction being a direction intersecting the first direction, and a pressing member exerting a holding-and-pressing force pressing the bearing portion toward the positioning portion, and, in a state in which the bearing portion is in contact with the positioning portion, the holding-and-pressing force has a component force in the first direction, and the transfer pressing force has a component force in the second direction that is oriented to press the bearing portion toward the positioning portion.

16 Claims, 21 Drawing Sheets

IMAGE FORMING APPARATUS

BACKGROUND OF THE INVENTION

Field of the Invention

The present invention relates to an image forming apparatus.

Description of the Related Art

In an image forming apparatus which uses an electrophotographic system, a process cartridge (hereinafter referred to as a cartridge) which has a photosensitive drum, charging means, developing means, and cleaning means which are integrally disposed in a frame, and is attachable to and detachable from an image forming apparatus main body (hereinafter referred to as an apparatus main body) is in practical use. The photosensitive drum in the cartridge and a transfer roller provided in the apparatus main body form a transfer nip, and a toner image is transferred to a recording material in the transfer nip. The transfer roller is pressed toward the photosensitive drum, and the transfer nip is thereby formed. A force which presses the transfer roller toward the photosensitive drum is referred to as a transfer pressing force. In a configuration in which a transport direction of a recording material in a transfer unit is close to a horizontal direction as in an image forming apparatus described in Japanese Patent Application Publication No. 2019-15978, the direction of the transfer pressing force is close to a vertical direction. In the image forming apparatus in Japanese Patent Application Publication No. 2019-15978, the transfer pressing force acts so as to push the photosensitive drum upward. The position of the photosensitive drum (the position of the rotation center of a rotation axis) is preferably maintained at a predetermined position even when the photosensitive drum receives the transfer pressing force from the transfer roller. This is because, when the position of the photosensitive drum changes, there is a possibility that an image may not be formed properly on a recording material, operation noise may be increased, or durability of the image forming apparatus may be reduced. In the image forming apparatus in Japanese Patent Application Publication No. 2019-15978, the cartridge includes a pressing member (spring) which exerts a downward holding and pressing force on a bearing portion which holds the rotation axis of the photosensitive drum, and the position of the photosensitive drum is thereby prevented from changing due to the upward transfer pressing force from the transfer roller.

SUMMARY OF THE INVENTION

In the image forming apparatus in Japanese Patent Application Publication No. 2019-15978, in the process of inserting the cartridge into the apparatus main body, the bearing portion of the photosensitive drum comes into contact with the pressing member first, pushes up and gets over the pressing member against the holding and pressing force, and is pressed in until the bearing portion comes into contact with a positioning portion of the apparatus main body. A user presses in the cartridge by application of a force required for pushing up the pressing member against the holding and pressing force. When the cartridge is taken out of the apparatus main body, similarly, the cartridge is pulled out by application of the force required for pushing up the pressing member against the holding and pressing force. Accordingly, from the viewpoint of operability when the cartridge is attached and detached, the holding and pressing force of the pressing member is preferably small. However, when the holding and pressing force is reduced, there is a possibility that the position of the photosensitive drum cannot be properly maintained.

An object of the present invention is to improve operability when a cartridge is attached and detached while properly maintaining the position of a photosensitive drum in an image forming apparatus in which the cartridge is attachable to and detachable from an apparatus main body.

An image forming apparatus according to the present invention comprising:

a cartridge having a photosensitive drum; and an apparatus main body to and from which the cartridge is attachable and detachable, wherein the apparatus main body includes:

a transfer roller configured to form a transfer nip by exerting a transfer pressing force on the photosensitive drum in a state the cartridge is attached to the apparatus main body;

a positioning portion configured to position the photosensitive drum in a first direction and a second direction by being contacted by a bearing portion which is holding a rotation axis of the photosensitive drum, the first direction being in a virtual plane perpendicular to the rotation axis, and the second direction being a direction which intersects the first direction; and a pressing member configured to exert a holding and pressing force which presses the bearing portion toward the positioning portion, and, in a state in which the bearing portion is in contact with the positioning portion, the holding and pressing force has a component force in the first direction, and the transfer pressing force has a component force in the second direction that is oriented to press the bearing portion toward the positioning portion.

According to the present invention, in the image forming apparatus in which the cartridge is attachable to and detachable from the apparatus main body, it is possible to improve the operability when the cartridge is attached and detached while properly maintaining the position of the photosensitive drum.

Further features of the present invention will become apparent from the following description of exemplary embodiments with reference to the attached drawings.

DESCRIPTION OF THE EMBODIMENTS

Embodiment 1

Hereinbelow, an electrophotographic image forming apparatus (hereinafter referred to as an image forming apparatus) according to Embodiment 1 of the present invention will be described in detail based on the drawings. In the following description, it is assumed that, unless otherwise specified, an installation surface of the image forming apparatus is a horizontal surface, a description such as upper, an upper side, or an upper portion means an upward direction along the direction of gravity, and a description such as lower, a lower side, or a lower portion means a downward direction along the direction of gravity. In addition, it is assumed that, unless otherwise specified, terms denoting shapes such as straight, circular, parallel, and vertical and geometrical relationships include shapes and relationships which are made different from mathematically strict shapes and relationships corresponding to the terms due to manufacturing tolerance or the like. Further, there is used an XYZ coordinate system in which a direction in which a transport direction of a recording medium in the image forming apparatus is projected on the horizontal surface is an X direction, a direction parallel to the rotation axis of a photosensitive drum of the image forming apparatus is a Y direction, and an upward direction along the direction of gravity is a Z direction.

A description will be given of the overall configuration of the image forming apparatus according to Embodiment 1 and an image forming process by using FIG. 1.

Figure 1:
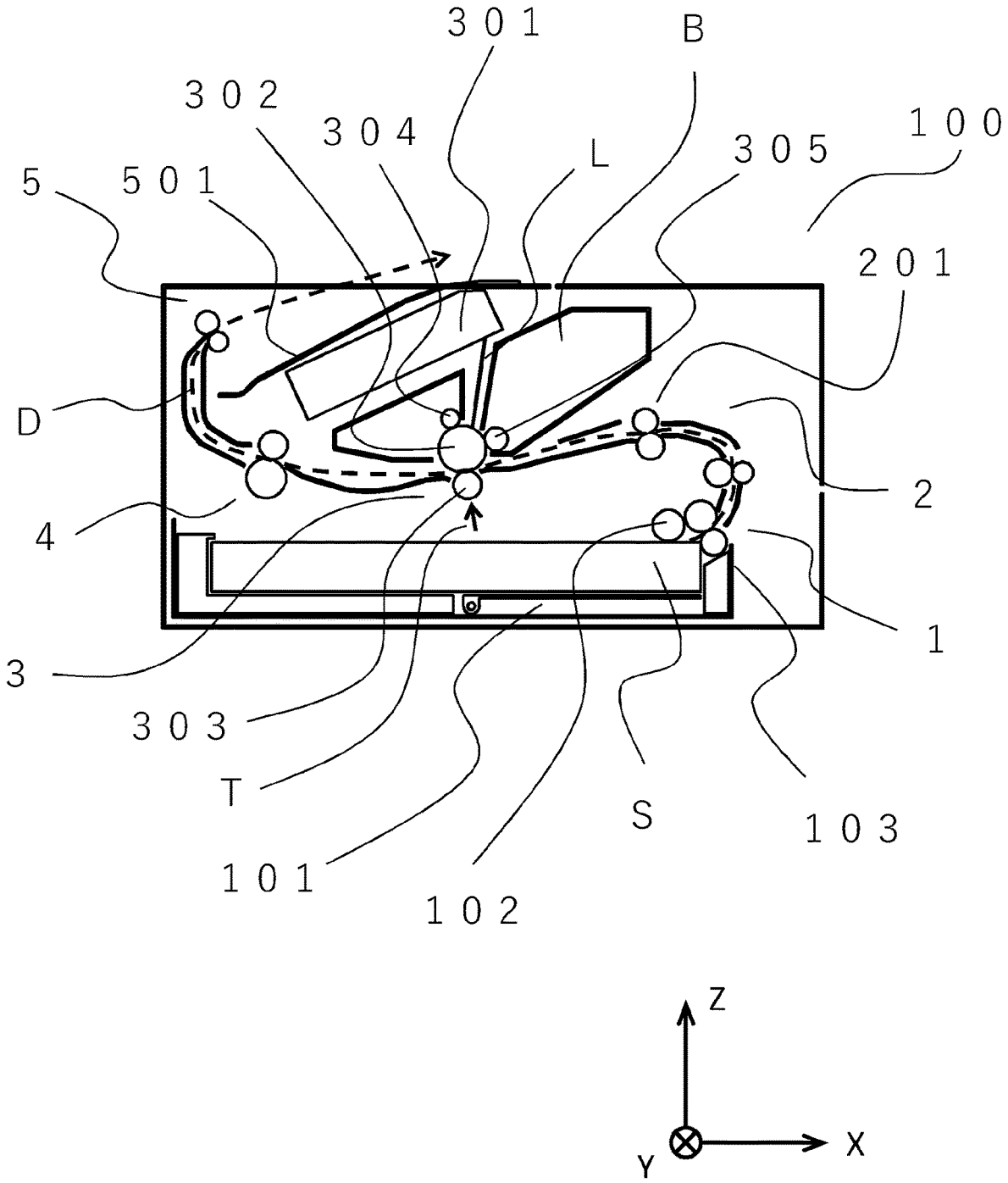
FIG. 1 is a schematic view of an image forming apparatus according to Embodiment 1.

FIG. 1 is a view schematically showing cross sections of an apparatus main body 100 (an electrophotographic image forming apparatus main body, an image forming apparatus main body) of the image forming apparatus according to Embodiment 1 and a process cartridge B (hereinafter referred to as a cartridge). Herein, the apparatus main body 100 is a portion obtained by excluding the cartridge B from the electrophotographic image forming apparatus. Examples of the image forming apparatus include an electrophotographic copier, an electrophotographic printer (an LED printer, a laser beam printer, and the like), a facsimile apparatus, and a word processor.

Overall Configuration of Image Forming Apparatus

The image forming apparatus shown in FIG. 1 is a laser beam printer which allows the cartridge B to be attached to and detached from the apparatus main body 100 and utilizes electrophotographic technique. When the cartridge B is attached to the apparatus main body 100, an exposure apparatus 301 (hereinafter referred to as a laser scanner unit) for forming a latent image on an electrophotographic photosensitive drum 302 (hereinafter referred to as a photosensitive drum) serving as an image bearing member of the cartridge B is disposed above the cartridge B. In addition, a sheet tray 101 which stores a recording medium (hereinafter referred to as a sheet S) such as paper or a plastic sheet serving as an image formation target is disposed below the cartridge B. Note that the photosensitive drum 302 is a drum-shaped photosensitive member (electrophotographic photosensitive member) which serves as an image bearing member used for electrophotographic image formation. Further, in the apparatus main body 100, a paper feed unit 1, a transport unit 2, a transfer unit 3, a fixing unit 4, and a paper discharge unit 5 are sequentially disposed along a transport direction D (an arrow in a dotted line) of the sheet S. Note that the present invention can also be applied to an image forming apparatus including a multi-stage paper feed unit, or an image forming apparatus which allows automatic duplex printing by transporting the sheet S from the paper discharge unit to a reverse unit.

Image Forming Process

Next, a series of operations of the image forming apparatus in Embodiment 1 will be described together with an image forming process.

Based on a print start signal, only one sheet S stored in the sheet tray 101 is fed by a pickup roller 102 and a separation unit 103 in the paper feed unit 1. The fed sheet S is transported to the transfer unit 3 by a transport roller pair 201 of the transport unit 2. When the sheet S is transported to a predetermined position, an image formation start signal is issued. The transport unit 2 has a sheet tip detection unit which is not shown and, when a sheet tip is detected, the image formation start signal is issued. Based on the image formation start signal, the image forming process is started.

A charging roller 304 to which a bias voltage is applied comes into contact with an outer peripheral surface of the photosensitive drum 302, and charges the outer peripheral surface of the photosensitive drum 302 uniformly and evenly. The laser scanner unit 301 outputs laser light L corresponding to image information. The laser light L goes through a laser opening of the cartridge B and performs scanning exposure on the outer peripheral surface of the photosensitive drum 302. With this, an electrostatic latent image corresponding to the image information is formed on the outer peripheral surface of the photosensitive drum 302. Toner serving as a developer in the cartridge B is carried by a developing roller 305, is supplied to the photosensitive drum 302 correspondingly to the electrostatic latent image, and develops the electrostatic latent image. With this, the electrostatic latent image is made visible as a toner image on the photosensitive drum 302.

The sheet S is transported to the transfer unit 3 which is formed between the photosensitive drum 302 and the transfer roller 303 having elasticity by the transport unit 2. It is assumed that the transport direction D in the transfer unit 3 is a direction close to a horizontal direction. The transfer roller 303 comes into contact with the photosensitive drum 302 so as to press the photosensitive drum 302 in a direction indicated by an arrow T. A force with which the transfer roller 303 presses the photosensitive drum 302 is referred to as a transfer pressing force. When the image is formed, the photosensitive drum 302 and the transfer roller 303 are brought into contact with each other by the transfer pressing force, and a transfer nip is formed therebetween. When the sheet S passes through the transfer nip, the toner image is transferred from the photosensitive drum 302 to the sheet S.

The sheet S to which the toner image is transferred is separated from the photosensitive drum 302 and is transported to the fixing unit 4. Subsequently, the sheet S is subjected to pressurization and heating and fixing processing in a nip portion constituting the fixing unit 4, and the toner image is fixed to the sheet S. The sheet S subjected to fixing processing of the toner image reaches the paper discharge unit 5, and is discharged to a paper discharge tray 501 outside the main body.

Attachment of Cartridge

Next, an operation for attaching the cartridge B to the apparatus main body 100 will be described specifically. In the following description, the left side of the apparatus main body 100 means the left side when viewed in a −X direction from a side on which an opening-closing door 601 of the apparatus main body 100 is provided. The right side is a side opposite to the left side. In addition, it is assumed that the side on which the opening-closing door 601 is provided is a front side (+X direction side) of the apparatus main body 100. Note that the depiction of members which are not used in a description in Embodiment 1 will be omitted. In a relationship between the apparatus main body 100 and the cartridge B, the left side of the relationship therebetween and the right side thereof are identical to each other, and hence the description will be made by using the left side thereof as an example. Note that there are cases where members provided on the left side and the right side of the main body are distinguished from each other by using L and R in designations of the members.

Figure 2:
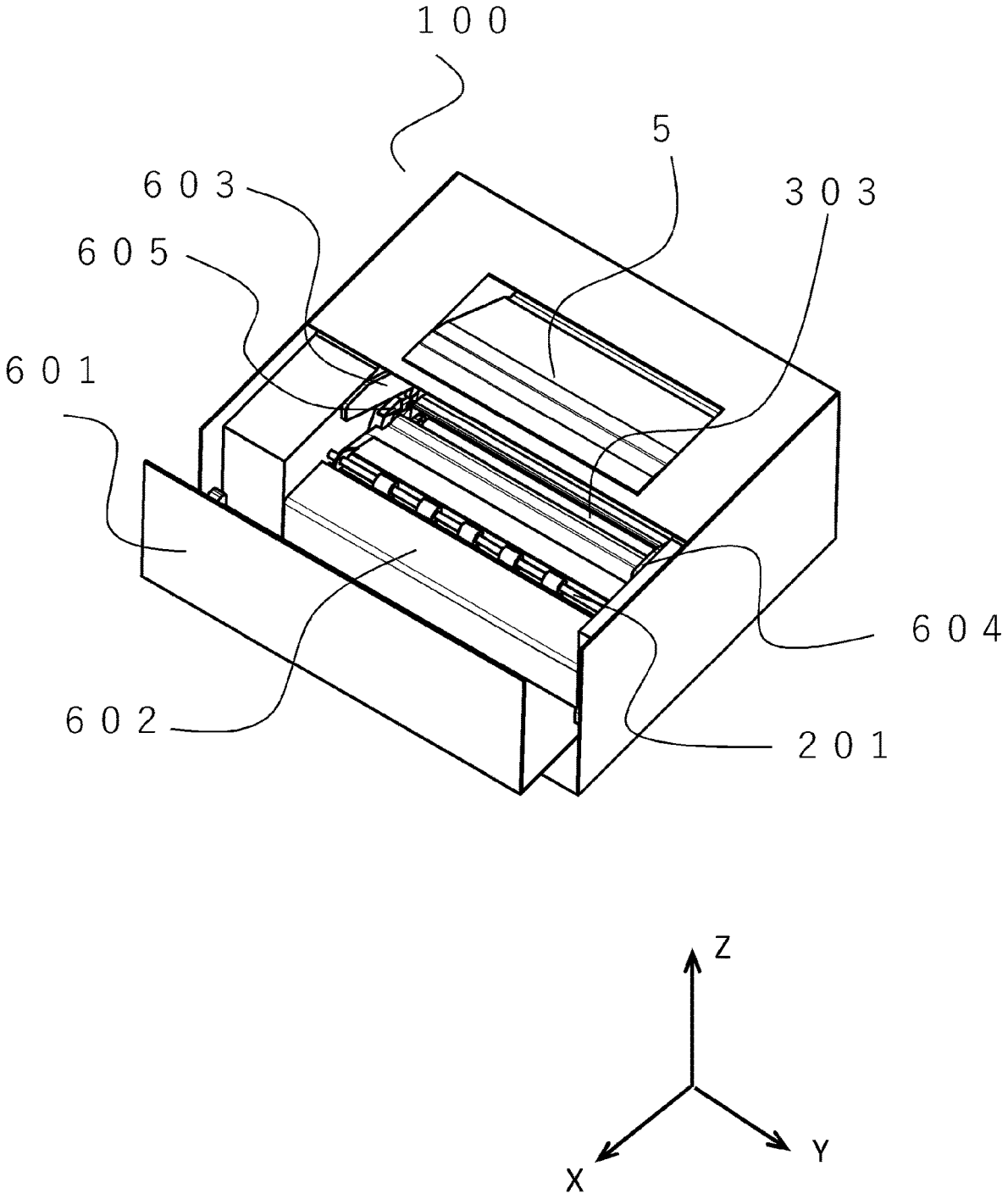
FIG. 2 is a perspective view of an apparatus main body in a state in which an opening-closing door is opened.
Figure 3:
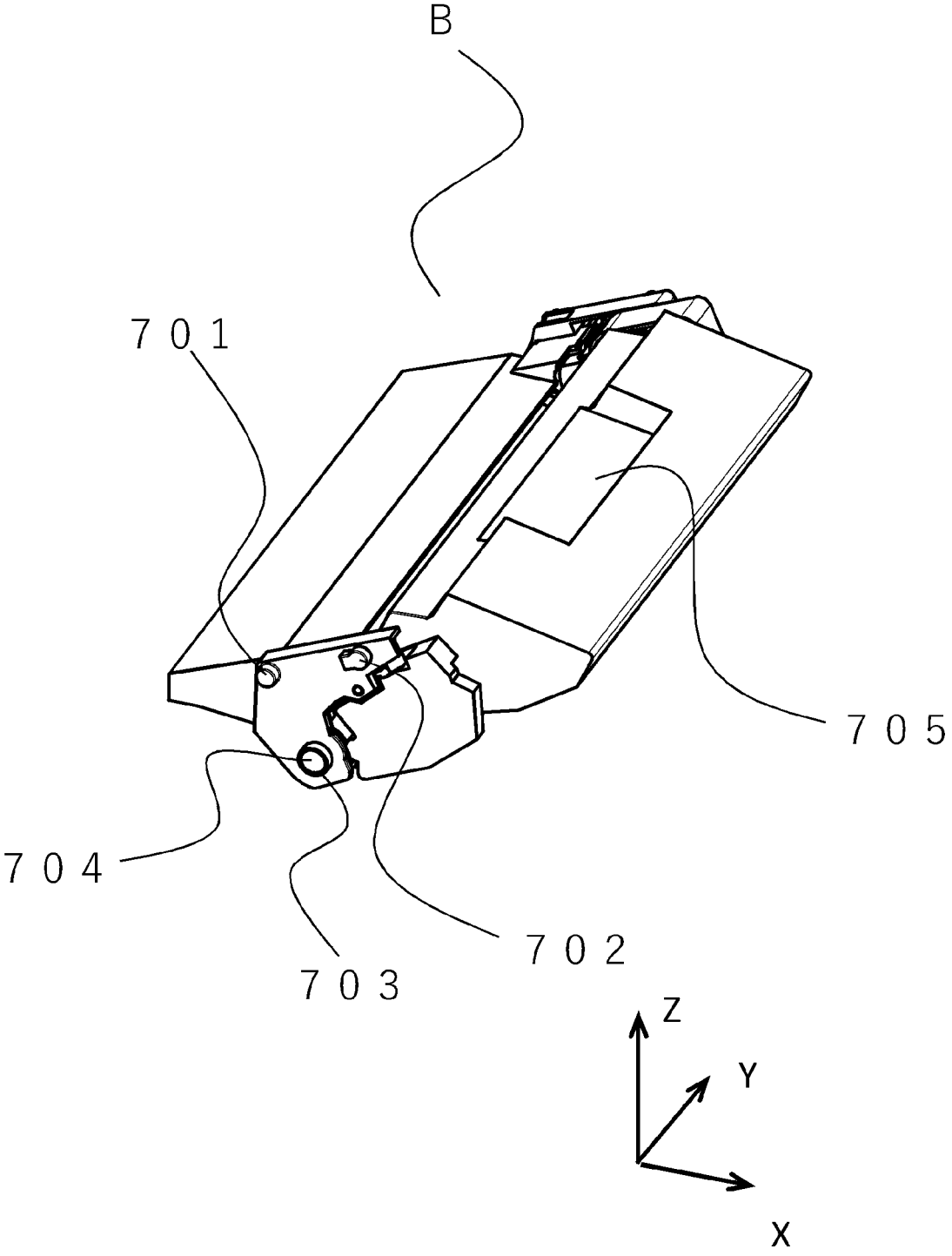
FIG. 3 is a perspective view of a cartridge when viewed from the left side of the apparatus main body.
Figure 4:
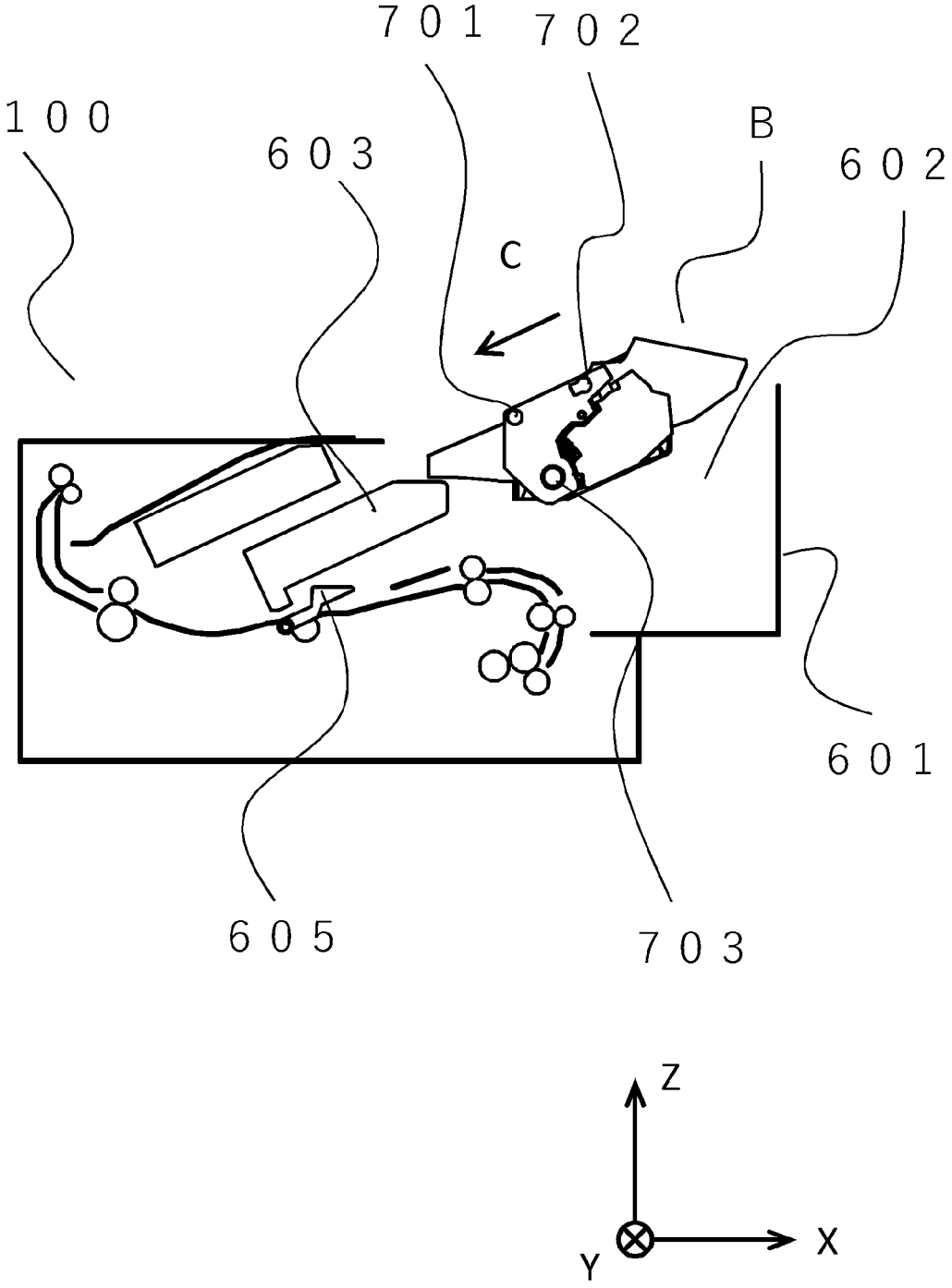
FIG. 4 is a view showing a state before insertion of the cartridge.

FIG. 2 shows a state in which the opening-closing door 601 of the apparatus main body 100 is opened. FIG. 2 is a perspective view when the apparatus main body 100 is viewed from above from the right front side. The opening-closing door 601 is a door for opening and closing an insertion opening 602 which is an opening for inserting the cartridge B into the apparatus main body 100 or taking the cartridge B out of the apparatus main body 100. FIG. 3 is an explanatory view of the left side of the cartridge B. The left side of the cartridge B is a side corresponding to the left side of the apparatus main body 100 when the cartridge B is inserted into the apparatus main body 100. FIG. 4 is a view showing a state immediately after the start of insertion of the cartridge B by a user in a state in which the opening-closing door 601 of the apparatus main body 100 is opened, and shows a state in which the internal portion of the apparatus main body 100 is viewed through the apparatus main body 100 from the left side (−Y direction side) of the apparatus main body 100. Similarly, each of FIGS. 5 to 11 is also a view showing a state in which the internal portion of the apparatus main body 100 is viewed through the apparatus main body 100.

Figure 12:
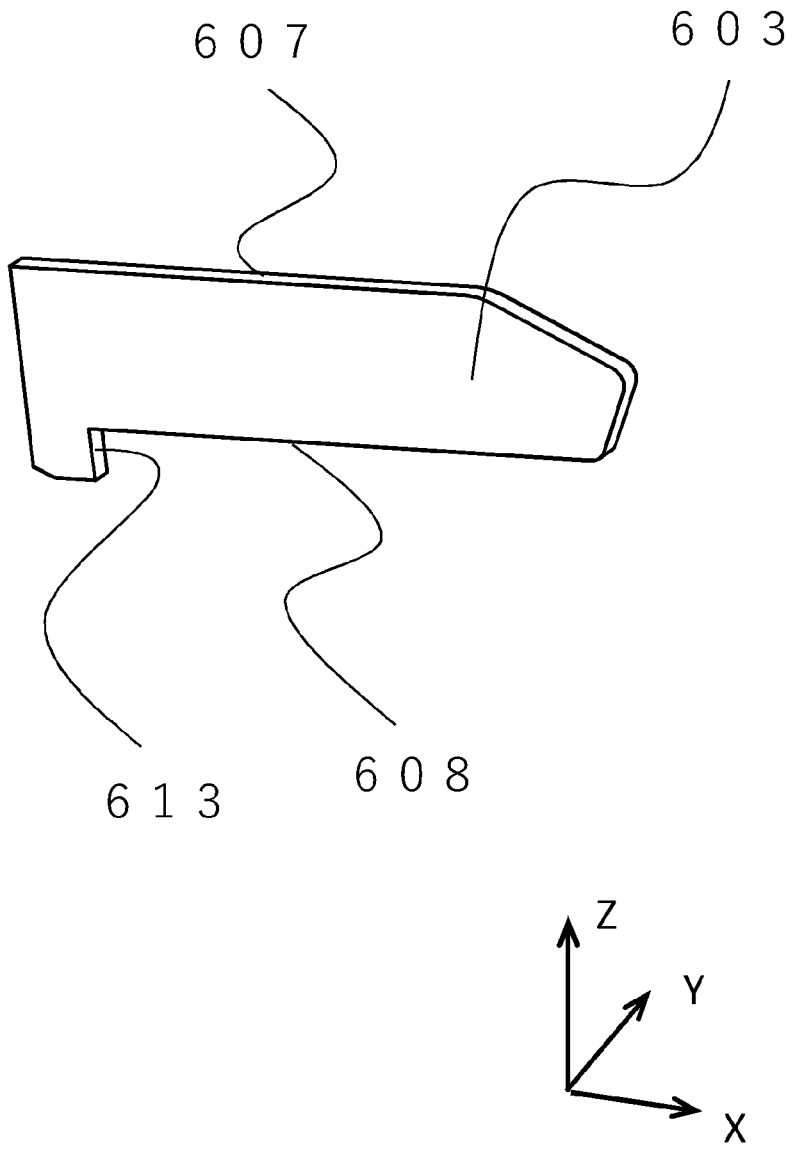
FIG. 12 is a perspective view of a guide rail.
Figure 13:
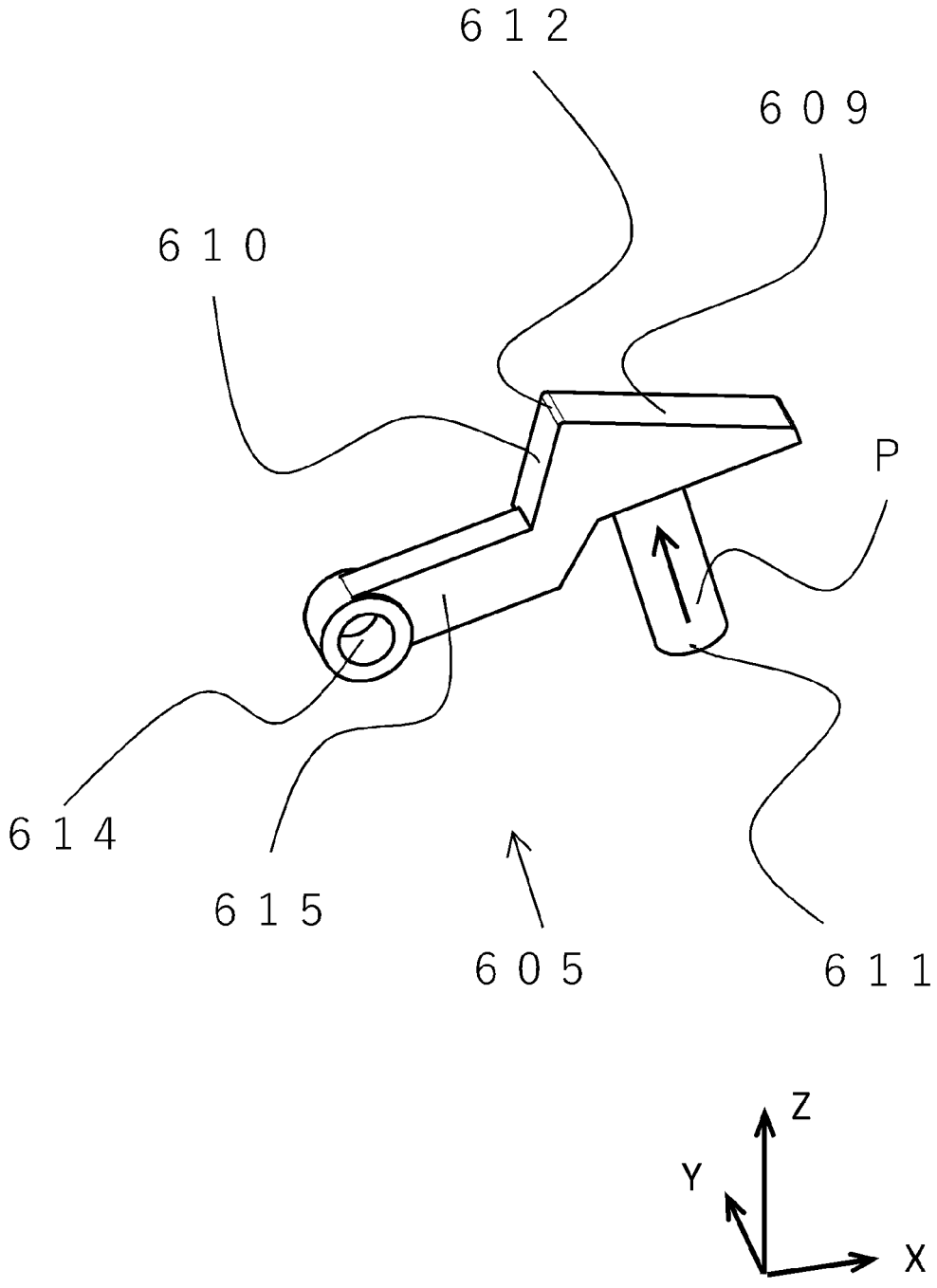
FIG. 13 is a perspective view of the pressing member.

FIG. 12 is a perspective view of a guide rail L603 which defines an insertion direction C when the cartridge B is inserted into the apparatus main body 100. FIG. 13 is a perspective view of a pressing member L605. In FIG. 13, an urging portion 611 is a coil-shaped elastic member.

The apparatus main body 100 has the opening-closing door 601, and is capable of opening and closing the insertion opening 602. As shown in FIG. 2, the guide rail L603 and a guide rail R604 are provided on left and right walls of the apparatus main body 100 in the insertion opening 602. The guide rail L603 and the guide rail R604 guide the cartridge B which the cartridge B is attached to and detached from the apparatus main body 100, and define the insertion direction C of the cartridge B. That is, when the cartridge B is inserted into the apparatus main body 100, by moving the cartridge B along the guide rail L603 and the guide rail R604, the insertion direction of the cartridge B becomes a direction parallel to an upper guide portion 607 and a lower guide portion 608 (indicated by an arrow C). A relationship between the insertion of the cartridge B and the guide rail L603 and a relationship between the insertion of the cartridge B and the guide rail R604 are identical to each other, and hence, hereinafter, a description will be made by using the guide rail L603 as an example.

As shown in FIG. 12, the guide rail L603 includes the upper guide portion 607 on its upper side, and the lower guide portion 608 on its lower side. In addition, the guide rail L603 includes a far-side abutment surface 613 which is perpendicular to the insertion direction (the direction of the arrow C) of the cartridge B. The lower guide portion 608 and the far-side abutment surface 613 are positioning portions which position a bearing portion 703 by being contacted by the bearing portion 703 which holds the rotation axis of the photosensitive drum 302 of the cartridge B. With these positioning portions, the photosensitive drum 302 is positioned in a first direction (a direction perpendicular to the far-side abutment surface 613) in a virtual plane perpendicular to the rotation axis of the photosensitive drum 302, and a second direction (a direction perpendicular to the lower guide portion 608) which intersects the first direction. That is, part of the guide rail L603 functions as the positioning portions.

The apparatus main body 100 has the pressing member L605 shown in FIG. 13 below the guide rail L603. The pressing member L605 exerts a holding and pressing force on the bearing portion 703 in a state in which the cartridge B is attached to the apparatus main body 100 and the bearing portion 703 of the photosensitive drum 302 is in contact with the positioning portions (the lower guide portion 608 and the far-side abutment surface 613). The pressing member L605 presses the bearing portion 703 against the far-side abutment surface 613 serving as the positioning portion at least in the first direction (the direction perpendicular to the far-side abutment surface 613). The apparatus main body 100 also has the same pressing member on the right side of the apparatus main body 100. The functions of the pressing members on the right side and the left side are identical to each other, and hence, hereinafter, a description will be made by using the pressing member L605 as an example.

As shown in FIG. 4, by opening the opening-closing door 601 and moving the cartridge B close to the insertion opening 602, the user starts the insertion of the cartridge B. As shown in FIG. 3, the cartridge B has a first guide boss 701 and a second guide boss 702. In addition, the cartridge B has a photosensitive drum pin 704 corresponding to the rotation axis of the photosensitive drum 302, and the bearing portion 703 is provided so as to surround its outer periphery. The bearing portion 703 has a cylindrical outer peripheral surface which protrudes from a side surface of the cartridge B in a −Y direction. The user inserts the cartridge B so as to move the first guide boss 701, the second guide boss 702, and the outer peripheral surface of the bearing portion 703 along the guide rail L603, and the cartridge B is thereby guided such that the insertion direction becomes a predetermined direction (indicated by the arrow C). The rotation axis of the photosensitive drum 302 and the bearing portion 703 are concentric with each other. That is, the central axis of the cylindrical shape constituting the bearing portion 703 passes through the position of the photosensitive drum pin 704 which defines the position of the rotation axis of the photosensitive drum 302. The cartridge B has a handle portion 705, and the user grips the handle portion 705 and inserts the cartridge B into the apparatus main body 100.

Figure 5:
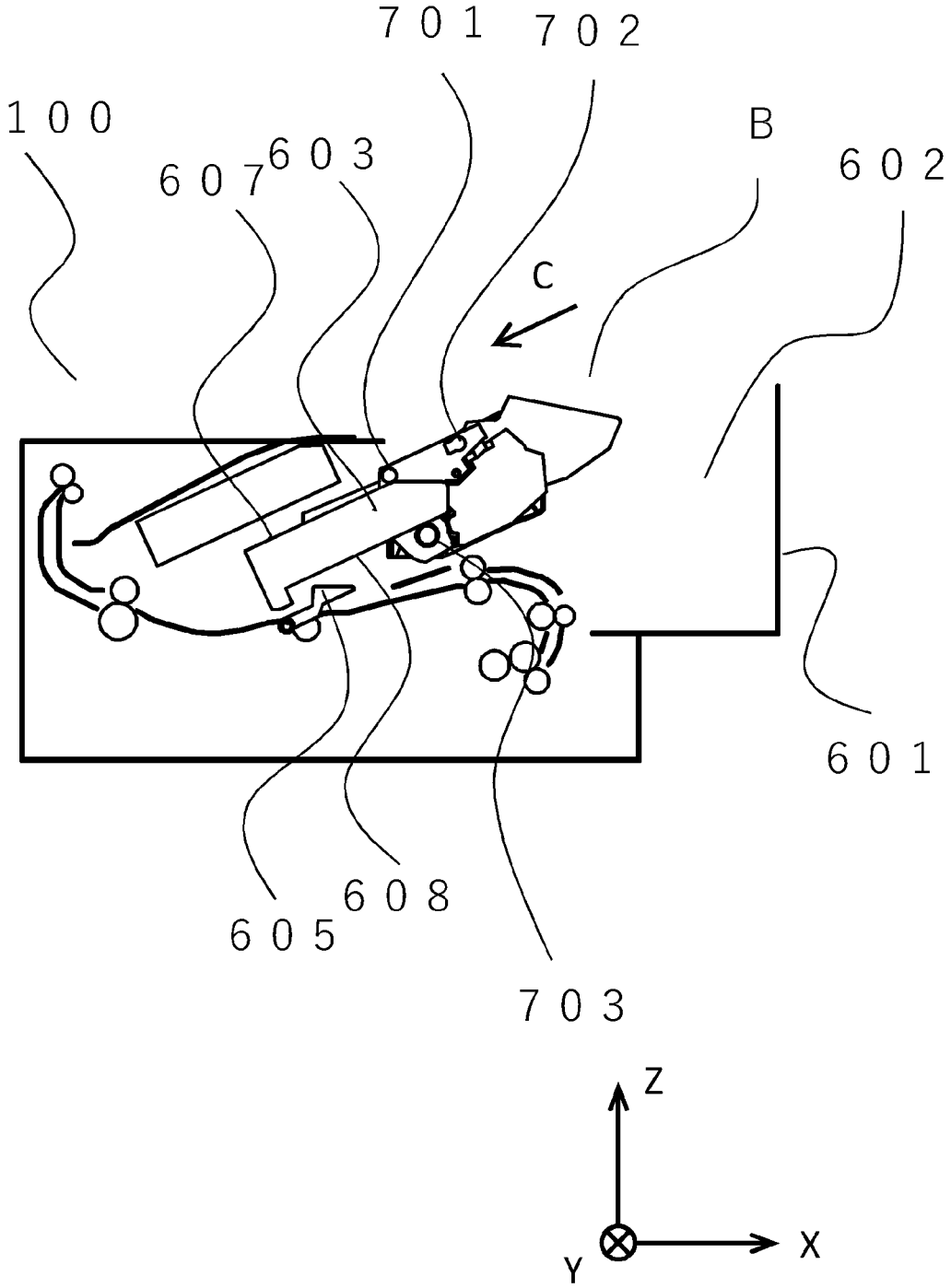
FIG. 5 is a view showing a state immediately after the start of the insertion of the cartridge.

FIG. 5 shows a state immediately after the start of the insertion of the cartridge B into the apparatus main body 100. The user starts the insertion such that the first guide boss 701 gets on the upper guide portion 607 and the bearing portion 703 is positioned below the lower guide portion 608. From this state, the cartridge B is further inserted in the direction of the arrow C which is the insertion direction of the cartridge B, and the second guide boss 702 is placed on the upper guide portion 607.

While the user grips the handle portion 705, the cartridge B receives a downward force due to gravity. Therefore, the first guide boss 701 and the second guide boss 702 are brought into intimate contact with the upper guide portion 607, and a gap is formed between the bearing portion 703 and the lower guide portion 608. Note that, in the case where the user performs an operation such as intentionally lifting up the handle portion 705, relationships of the contact and the gap of the first guide boss 701, the second guide boss 702, and the bearing portion 703 with respect to the guide rail L603 can change, but, herein, no consideration is given to the change.

Figure 6:
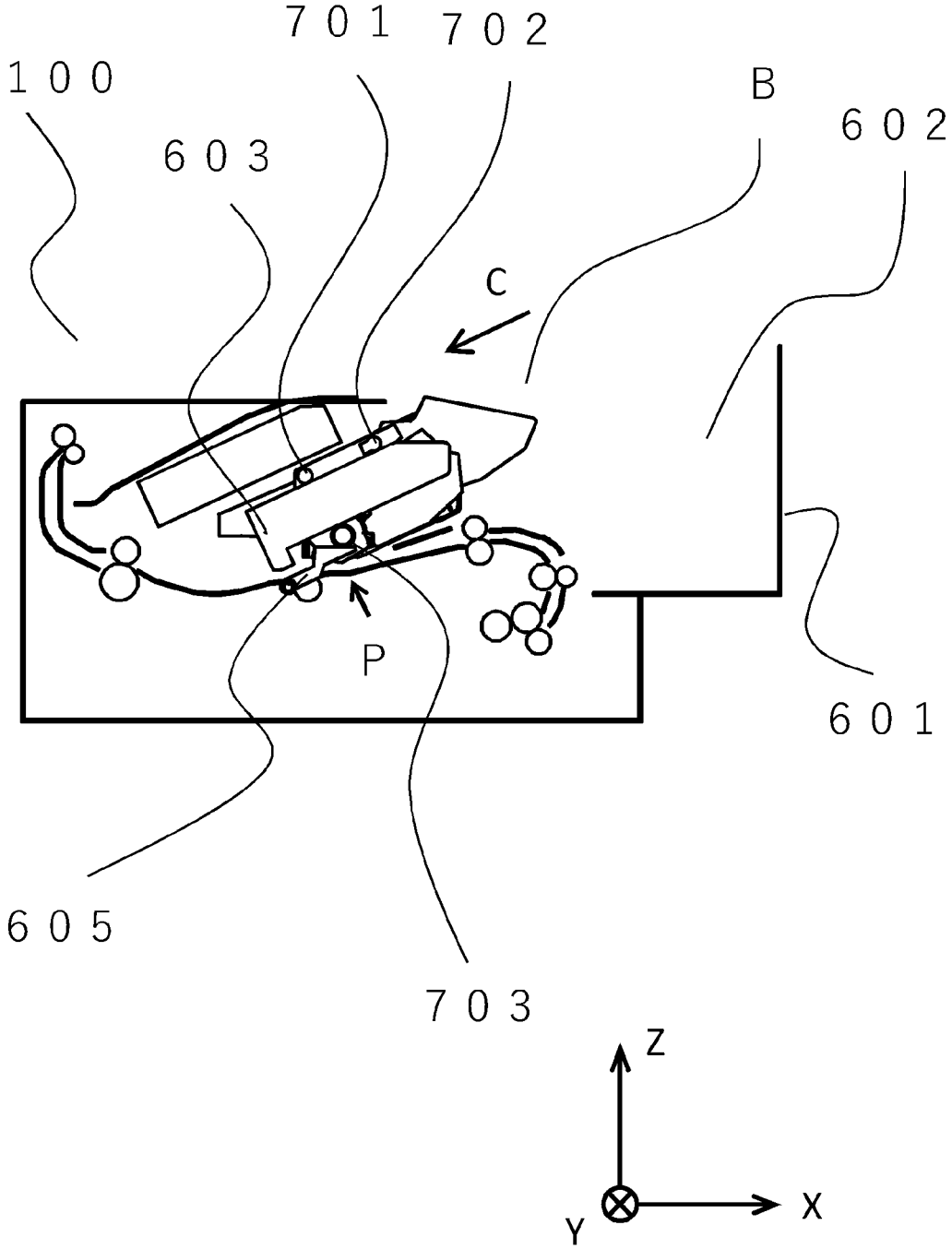
FIG. 6 is a view showing a state in which the cartridge reaches a pressing member.
Figure 7:
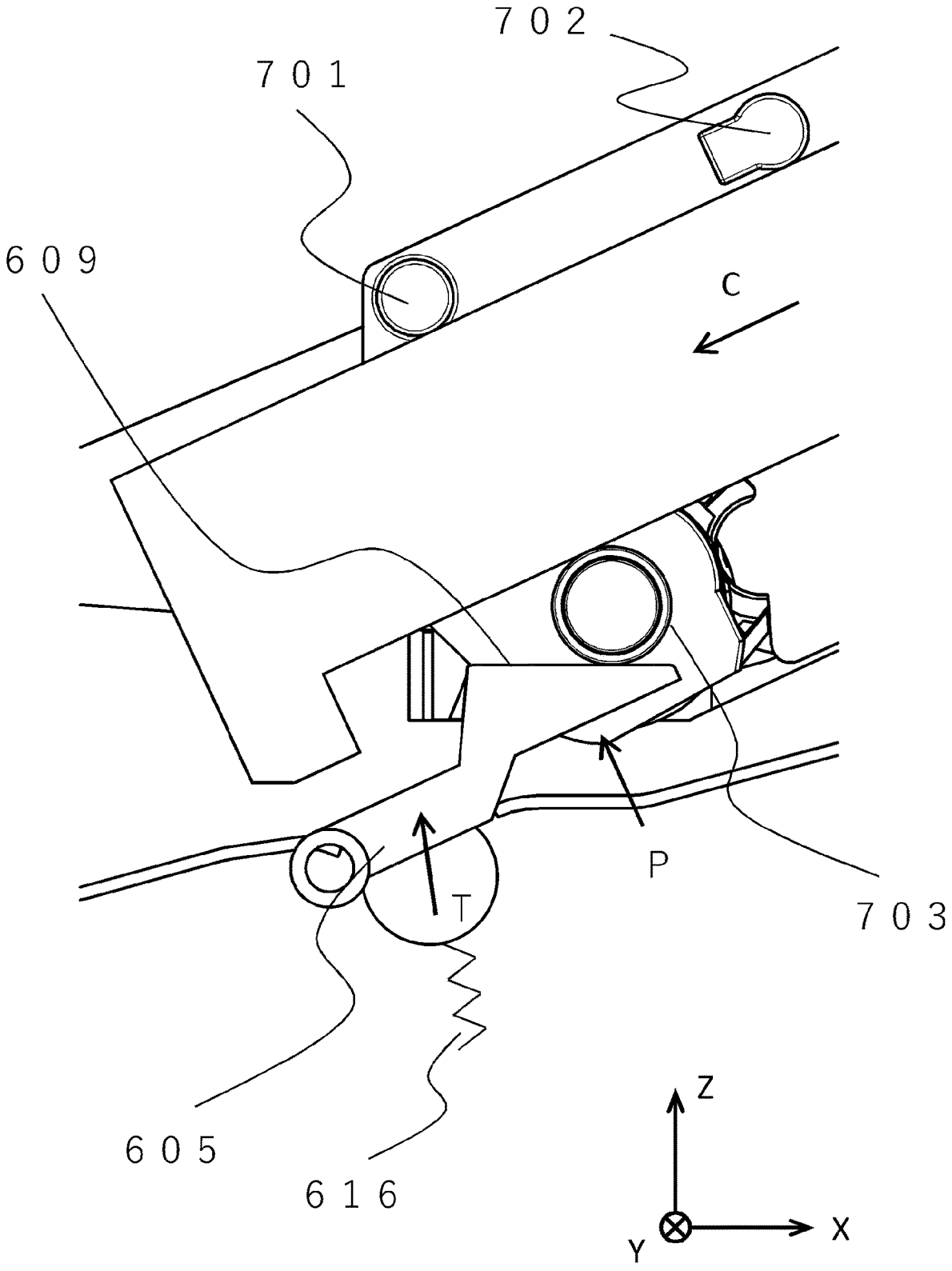
FIG. 7 is an enlarged view of a surrounding portion of a bearing portion in the state in which the cartridge reaches the pressing member.

FIG. 6 shows a state in which the insertion of the cartridge B progresses and the bearing portion 703 reaches the pressing member L605. In addition, FIG. 7 is an enlarged view of a surrounding portion of the bearing portion 703 in the state in FIG. 6. As shown in FIG. 13, the pressing member L605 has a rotation portion 615 which rotates about a rotation center 614 in the virtual plane perpendicular to the rotation axis of the photosensitive drum 302, and the urging portion 611 which urges the rotation portion 615. One end of the urging portion 611 is connected to the rotation portion 615, and the other end thereof is connected to the apparatus main body 100. The urging portion 611 is an elastic member such as a coil spring. The pressing member L605 has a transfer roller urging portion 616 which urges the transfer roller 303 toward the photosensitive drum 302. The transfer roller 303 receives an urging force of the transfer roller urging portion 616 and presses the photosensitive drum 302. A direction in which the urging portion 611 urges the pressing member L605 (indicated by an arrow P) and a direction of the transfer pressing force in which the transfer roller 303 presses the photosensitive drum 302 (indicated by an arrow T) are substantially parallel to each other. The rotation portion 615 has a first inclined surface 610, a second inclined surface 609 which is connected to an end portion of the first inclined surface 610, and a top portion 612 which extends along the line of intersection of the first inclined surface 610 and the second inclined surface 609.

In the process of inserting the cartridge B, the user applies a force in the insertion direction C to the cartridge B to press the cartridge B after the bearing portion 703 of the cartridge B reaches the second inclined surface 609 of the pressing member L605, and the cartridge B is thereby moved further to a far side (in the insertion direction C). At this point, the bearing portion 703 of the cartridge B comes into contact with the second inclined surface 609 of the pressing member L605. With this, the bearing portion 703 of the cartridge B receives the action of the urging force by the urging portion 611 via the second inclined surface 609 of the pressing member L605. At this point, the bearing portion 703 of the cartridge B receives the urging force by the urging portion 611 as a force in a direction perpendicular to the second inclined surface 609 of the pressing member L605. The direction perpendicular to the second inclined surface 609 (outward normal direction) has a component in the insertion direction C that is oriented opposite to the insertion direction C. Accordingly, a component force in the direction of the insertion direction C of the urging force which the bearing portion 703 of the cartridge B receives from the urging portion 611 via the second inclined surface 609 of the pressing member L605 is a force in a direction opposed to the insertion direction C. The user applies a force to the cartridge B against the component force, whereby it is possible to press the cartridge B further to the far side while rotating the rotation portion 615. With this, the cartridge B is inserted while the pressing member L605 is pressed down in a direction opposite to the direction of the urging force P against the urging force by the urging portion 611.

Figure 8:
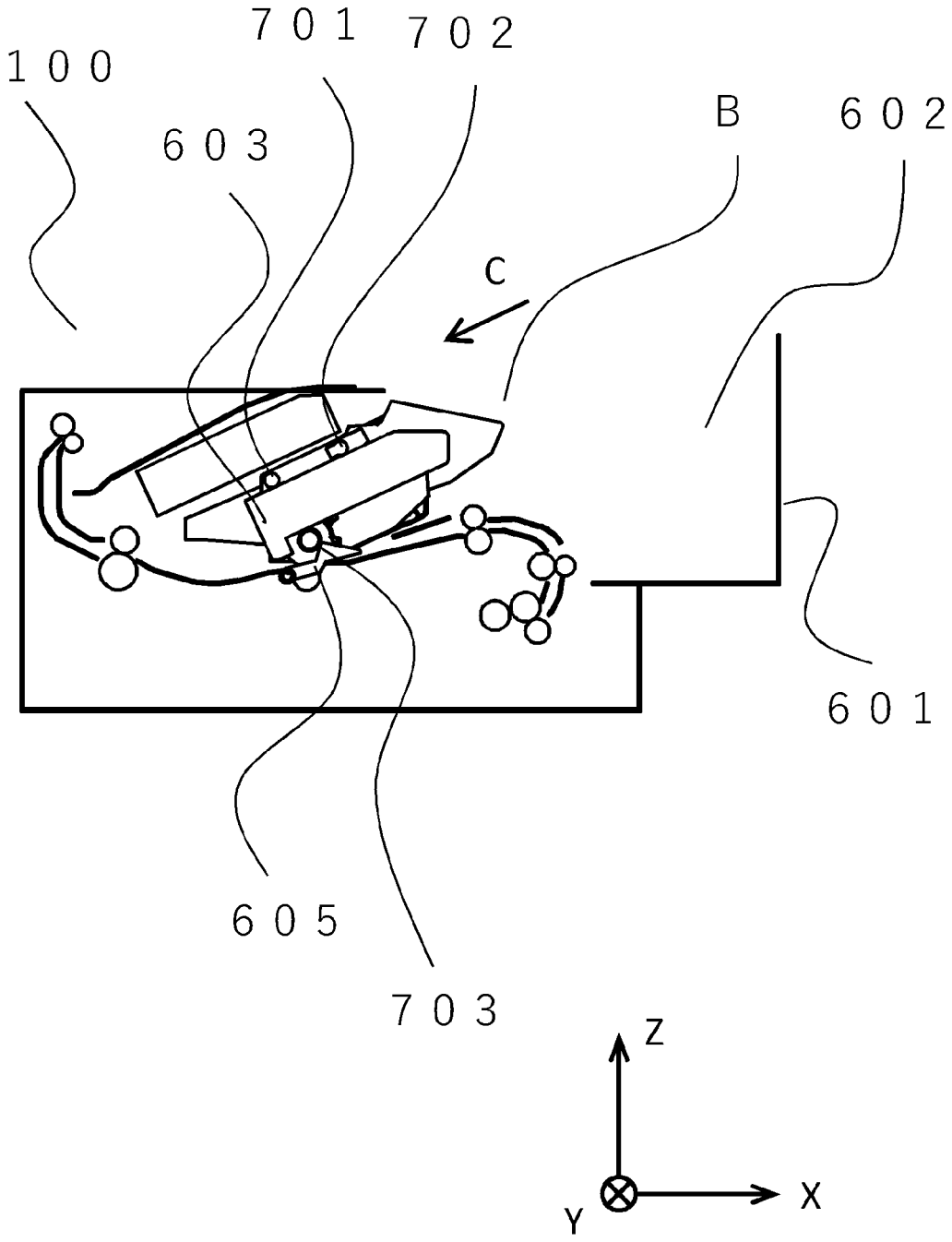
FIG. 8 is a view showing a state in which the cartridge gets over a top portion of the pressing member.
Figure 9:
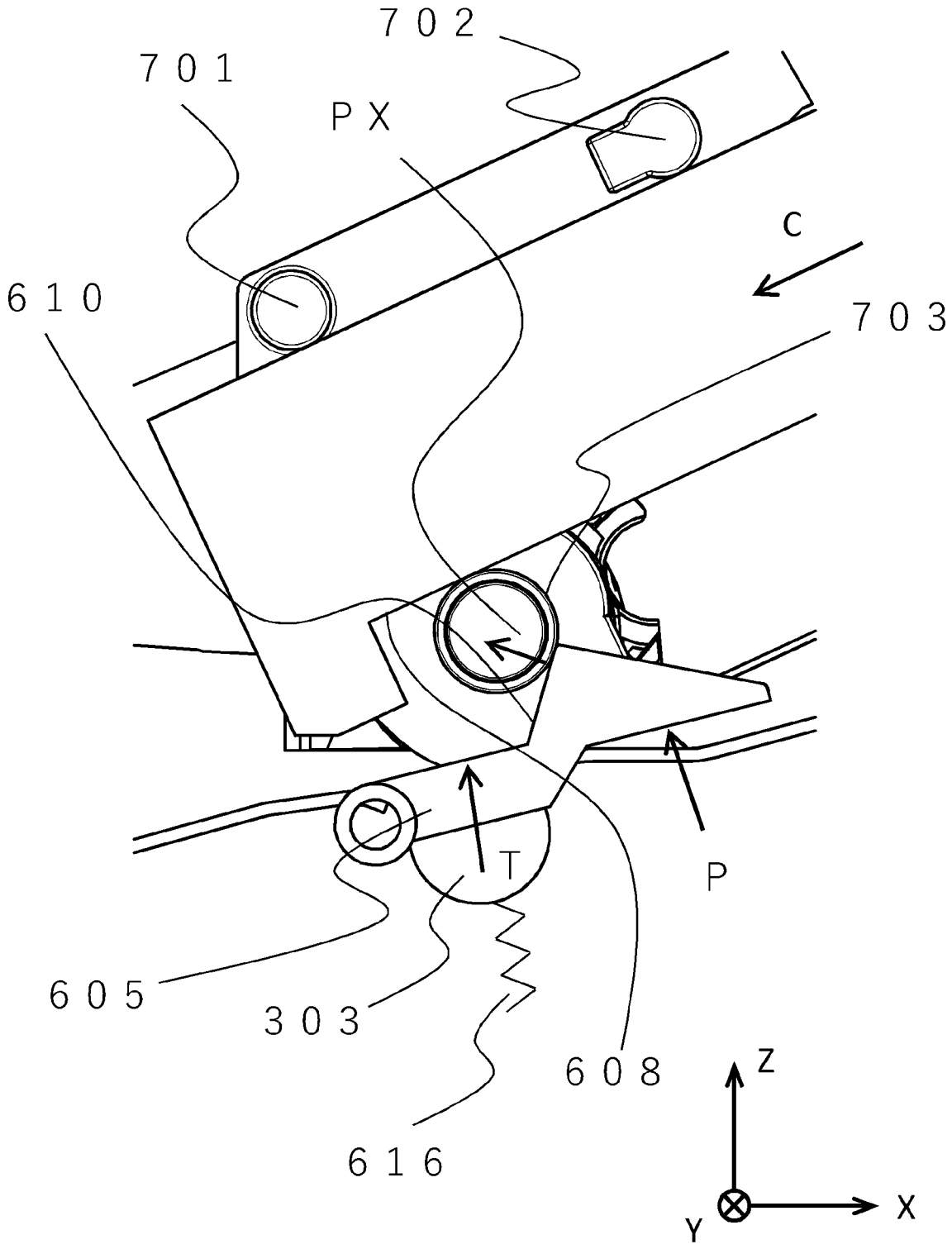
FIG. 9 is an enlarged view of the surrounding portion of the bearing portion in the state in which the cartridge gets over the top portion of the pressing member.

FIG. 8 shows a state in which the bearing portion 703 of the cartridge B advances while being in contact with the second inclined surface 609 of the pressing member L605 and gets over the top portion 612, and a contact portion with the pressing member L605 moves to the first inclined surface 610 from the second inclined surface 609. In addition, FIG. 9 is an enlarged view of the surrounding portion of the bearing portion 703 in the state in FIG. 8. In this state, the bearing portion 703 of the cartridge B is urged in a direction perpendicular to the first inclined surface 610 (indicated by an arrow PX) by the urging force by the urging portion 611 via the first inclined surface 610 of the pressing member L605. The bearing portion 703 reaches the positioning portions while being urged by the urging portion 611 via the first inclined surface 610 in a state in which the bearing portion 703 is in contact with the first inclined surface 610. A component in the insertion direction C of the direction perpendicular to the first inclined surface 610 (outward normal direction) has a direction identical to the insertion direction C, and a component perpendicular to the insertion direction C has a direction toward the lower guide portion 608 of the guide rail L603. Accordingly, the bearing portion 703 is urged toward the positioning portions (the lower guide portion 608 and the far-side abutment surface 613) by the urging force PX which the bearing portion 703 of the cartridge B receives from the urging portion 611 via the first inclined surface 610 of the pressing member L605, and comes into contact with the lower guide portion 608. That is, the urging force by the urging portion 611 acts on the bearing portion 703 of the cartridge B via the pressing member L605 in a direction which assists the insertion of the cartridge B.

In addition, when the insertion of the cartridge B progresses, the photosensitive drum 302 comes into contact with the transfer roller 303, and receives a vertical upward force (indicated by the arrow T) as the transfer pressing force from the transfer roller 303. The cartridge B is inserted while the photosensitive drum 302 presses down the transfer roller 303.

Figure 10:
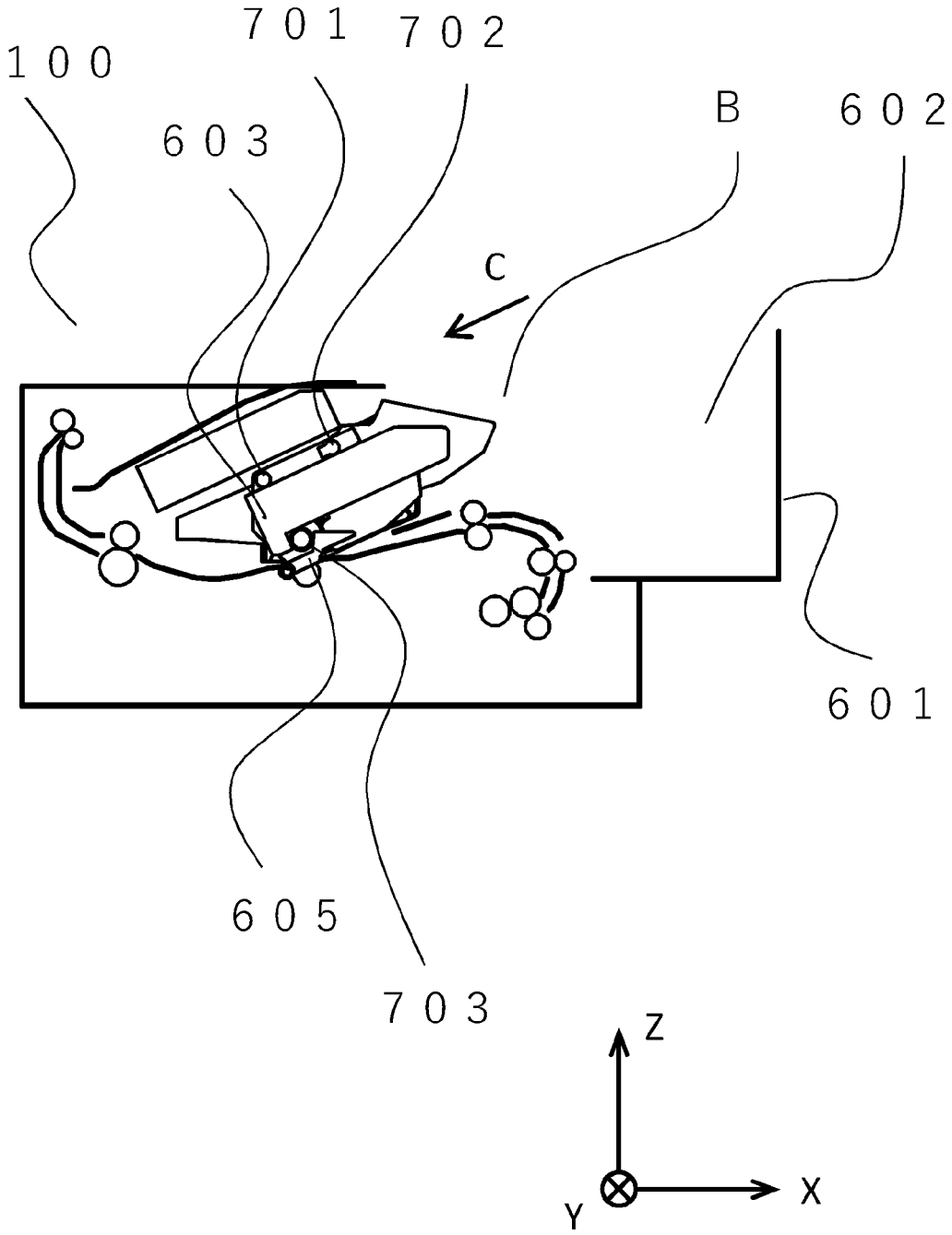
FIG. 10 is a view showing a state in which the insertion of the cartridge is completed.
Figure 11:
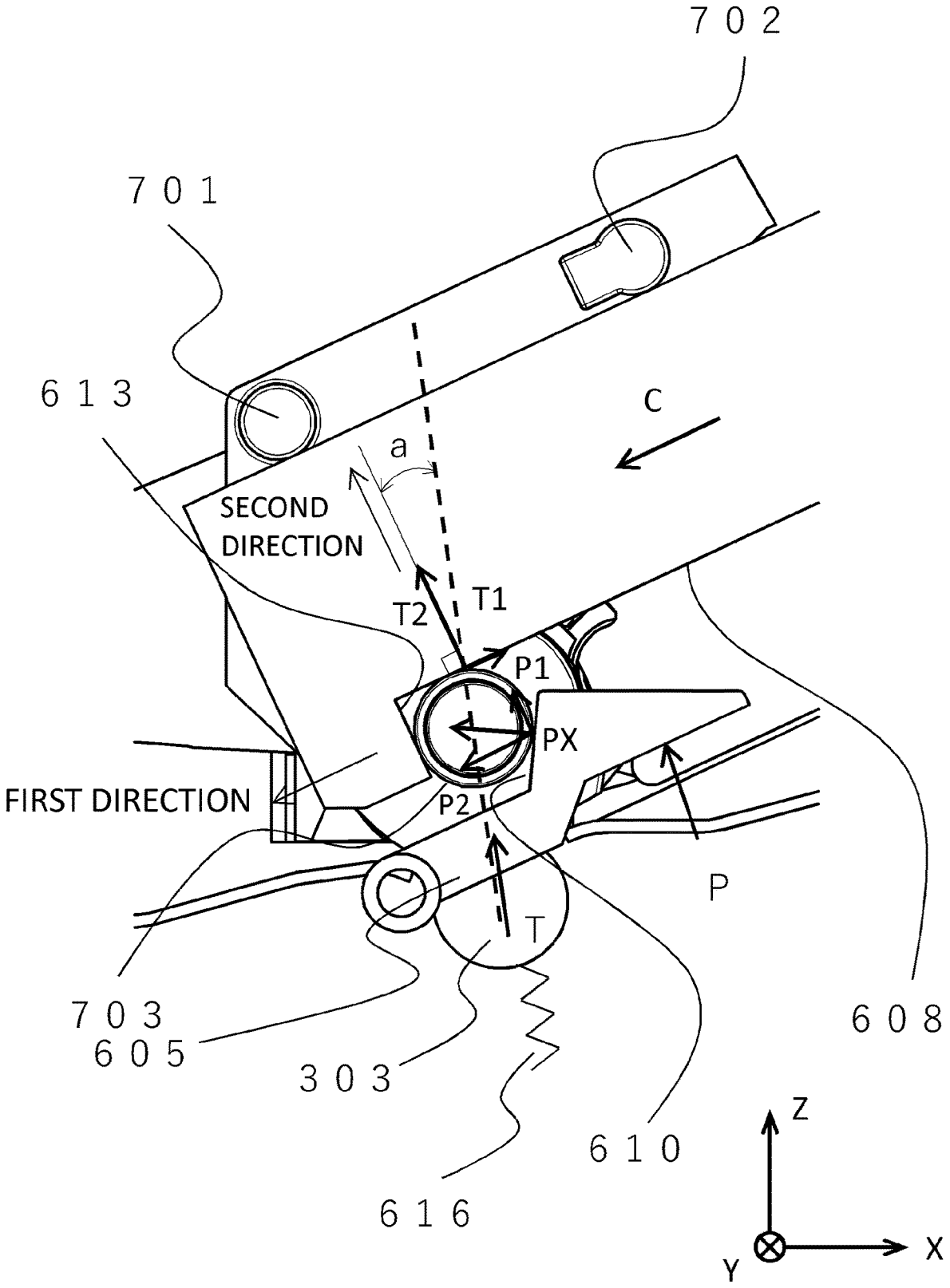
FIG. 11 is an enlarged view of the surrounding portion of the bearing portion in the state in which the insertion of the cartridge is completed.

FIG. 10 shows a state in which the cartridge B is completely inserted. In addition, FIG. 11 is an enlarged view of the surrounding portion of the bearing portion 703 in the state in FIG. 10. In the state in which the cartridge B is completely inserted, the bearing portion 703 is in contact with the positioning portions (the lower guide portion 608 and the far-side abutment surface 613). In this state, the first inclined surface 610 of the rotation portion 615 of the pressing member L605 comes into contact with the bearing portion 703 so as to hold the bearing portion 703 between the first inclined surface 610 and the positioning portions. The urging force of the urging portion 611 acts on the bearing portion 703 via the first inclined surface 610, whereby the pressing member L605 exerts the holding and pressing force.

The holding and pressing force PX exerted on the bearing portion 703 by the pressing member L605 in the state in which the bearing portion 703 is in contact with the positioning portions has a component force P1 which presses the bearing portion 703 against the positioning portion in the first direction (a component force P1 in the first direction that is oriented to press the bearing portion 703 toward the positioning portion), and a component force P2 which presses the bearing portion 703 against the positioning portion in the second direction (a component force P2 in the second direction that is oriented to press the bearing portion 703 toward the positioning portion). The first direction is a direction perpendicular to the far-side abutment surface 613, and the component force P1 presses the bearing portion 703 against the far-side abutment surface 613. The second direction is a direction perpendicular to the lower guide portion 608, and the component force P2 presses the bearing portion 703 against the lower guide portion 608.

In the state in which the bearing portion 703 is in contact with the positioning portions (the lower guide portion 608 and the far-side abutment surface 613), the transfer roller 303 comes into contact with the photosensitive drum 302 upward in the vertical direction. In addition, the second direction is the direction perpendicular to the lower guide portion 608, and the second direction has a vertical upward component.

Therefore, in the state in which the bearing portion 703 is in contact with the positioning portions, the transfer pressing force T which acts on the photosensitive drum 302 from the transfer roller 303 in contact with the photosensitive drum 302 has a component force T2 in the second direction which acts in a direction in which the bearing portion 703 is pressed against the positioning portion. In addition, the transfer pressing force T is inclined by an angle a in a direction opposite to the insertion direction C with respect to the second direction (the direction perpendicular to the lower guide portion 608). Consequently, the transfer pressing force T has a component force T1 in the first direction (the direction perpendicular to the far-side abutment surface 613) which acts in a direction that is oriented opposite to a direction of pressing the bearing portion 703 toward the positioning portion. The first direction is parallel to the direction C in which the cartridge B is inserted into the apparatus main body 100. Accordingly, in the state in which the bearing portion 703 is in contact with the positioning portions, the cartridge B receives a force which pushes back the cartridge B in a direction opposite to the insertion direction C.

Herein, in the state in which the bearing portion 703 is in contact with the positioning portions, the magnitude of the component force P1 with which the pressing member L605 presses the bearing portion 703 against the positioning portion in the first direction (the direction perpendicular to the far-side abutment surface 613) is larger than the magnitude of the component force T1 in the first direction of the transfer pressing force T. With this, the cartridge B is not pushed back in the direction opposite to the insertion direction C, and the bearing portion 703 can constantly maintain the state in which the bearing portion 703 is in contact with the positioning portions including the far-side abutment surface 613 and part of the lower guide portion 608.

Thus, according to Embodiment 1, the transfer pressing force T which acts on the photosensitive drum 302 from the transfer roller 303 in a state in which the cartridge B is attached has the component force T2 which presses the bearing portion 703 against the positioning portion (the lower guide portion 608) in the second direction. That is, the transfer pressing force T acts so as to maintain the position of the bearing portion 703 at least in the second direction (the direction perpendicular to the lower guide portion 608). Consequently, the holding and pressing force by the pressing member L605 for maintaining the position of the bearing portion 703 does not need to have a component force which presses the bearing portion 703 against the positioning portion in the second direction. The holding and pressing force by the pressing member L605 is adequate if the holding and pressing force is a force which presses the bearing portion 703 against the positioning portion (the far-side abutment surface 613) at least in the first direction. Embodiment 1 shows an example in which the component force P2 of the holding and pressing force by the pressing member L605 which presses the bearing portion 703 against the positioning portion in the second direction is not zero, but it is possible to set the component force P2 to zero. Therefore, it is possible to reduce the urging force P generated by the urging portion 611 serving as a source of the holding and pressing force of the pressing member L605.

In the process of inserting the cartridge B, it is necessary to cause the bearing portion 703 to come into contact with the second inclined surface 609 of the pressing member L605, to rotate the rotation portion 615 such that the second inclined surface 609 is pressed down against the urging force P which acts via the second inclined surface 609, and to cause the bearing portion 703 to get over the top portion 612. The source of a resistance force to the insertion of the cartridge B at this point is the urging force P generated by the urging portion 611. According to Embodiment 1, it is possible to reduce the urging force P generated by the urging portion 611, and hence it is possible to reduce the resistance force to the insertion of the cartridge B which is derived from the pressing member L605. Accordingly, it becomes possible to improve operability when the cartridge B is inserted without reducing the transfer pressing force T by the transfer roller 303. In addition, in the case where it is necessary to increase the transfer pressing force T due to request related to the quality of image formation as well, it is not necessary to significantly increase the urging force P generated by the urging portion 611, and hence it is possible to reduce an influence on the operability when the cartridge B is inserted.

As the angle a formed between the transfer pressing force T and the second direction (the direction perpendicular to the lower guide portion 608) is smaller, the component force T1 which pushes back the cartridge B in the direction opposite to the insertion direction C is smaller. Therefore, by reducing the angle a, it is possible to reduce the holding and pressing force PX which is exerted on the bearing portion 703 by the urging portion 611 via the first inclined surface 610 and, accordingly, it is possible to reduce the urging force generated in the urging portion 611.

In addition, in FIG. 9, after the bearing portion 703 gets over the top portion 612, the resistance force to the insertion of the cartridge B occurs due to friction between the guide rail L603 and the cartridge B or the like. To cope with this resistance force, the component force in the insertion direction C of the urging force PX which the bearing portion 703 receives from the urging portion 611 via the first inclined surface 610 may be set to be increased. With this, it is possible to assist a force of the user for inserting the cartridge B.

Embodiment 2

Figure 14:
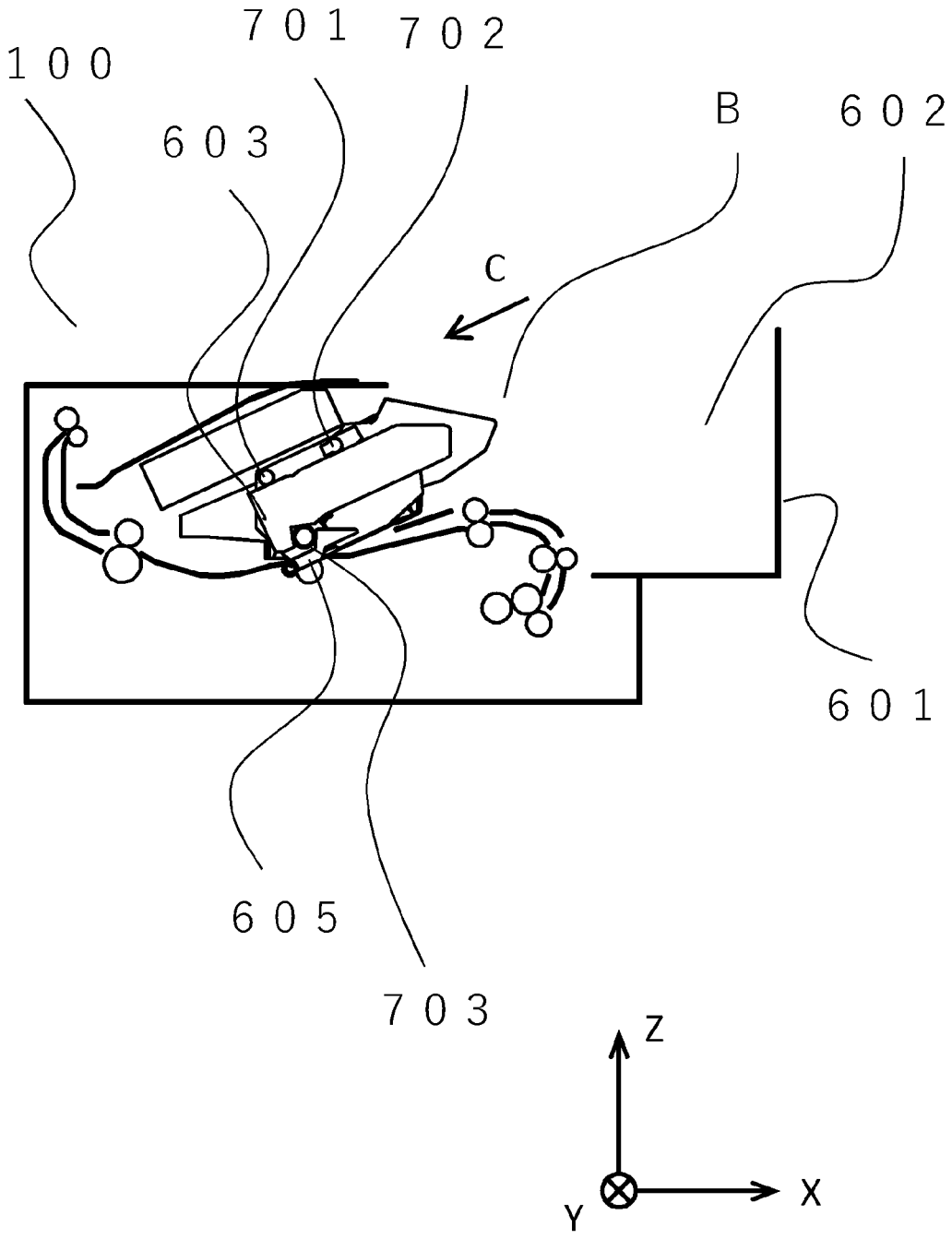
FIG. 14 is a view showing a state in which insertion of the cartridge in Embodiment 2 is completed.
Figure 15:
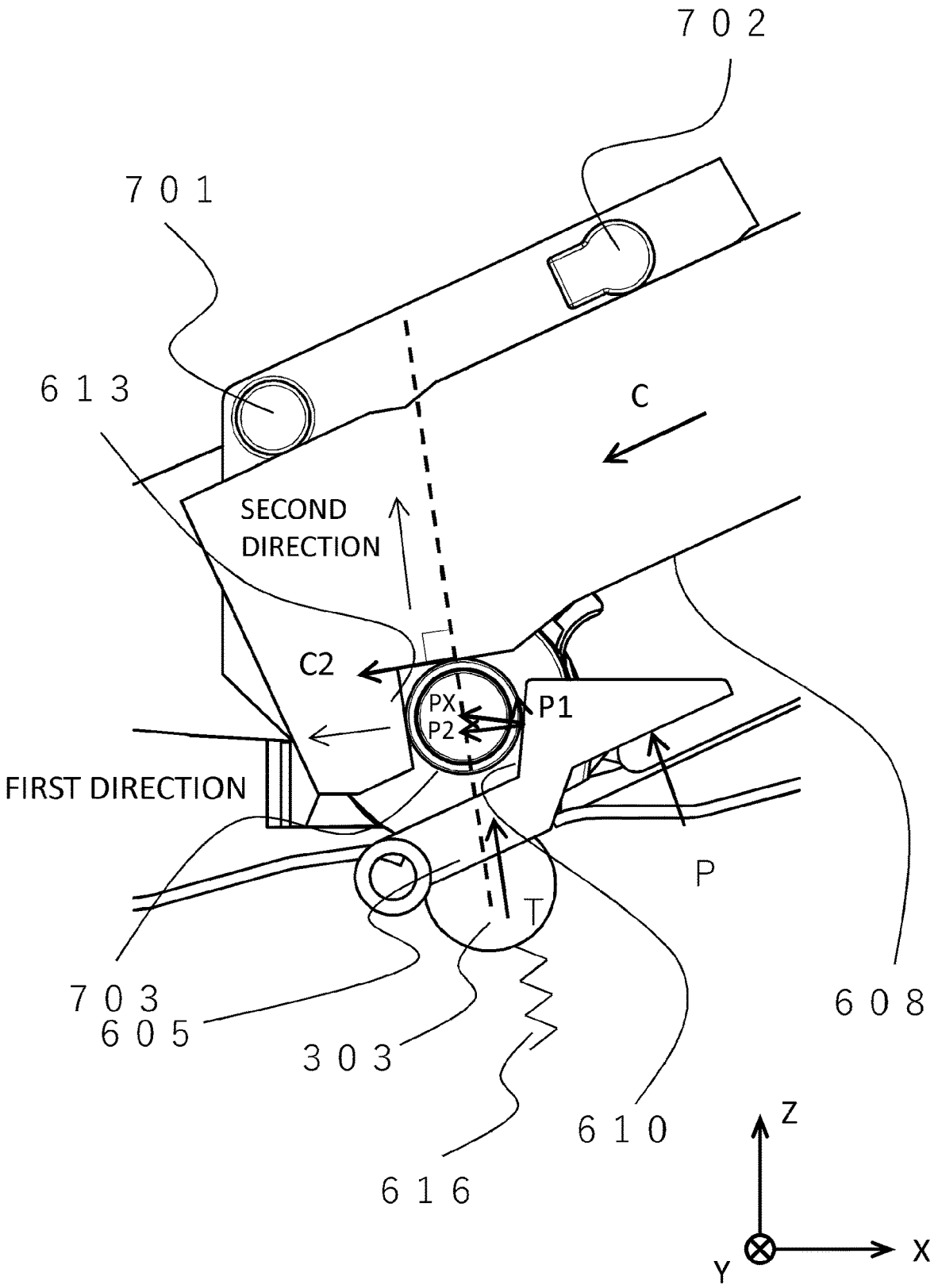
FIG. 15 is an enlarged view of the surrounding portion of the bearing portion in the state in which the insertion of the cartridge in Embodiment 2 is completed.

Embodiment 2 according to the present invention will be described. FIG. 14 is a view showing a state in which the insertion of the cartridge B according to Embodiment 2 is completed. In addition, FIG. 15 is an enlarged view of the surrounding portion of the bearing portion 703 in the state in FIG. 14. Note that the overall configuration of the image forming apparatus, the image forming process, and operations of individual portions performed until the insertion of the cartridge B is completed are the same as those in Embodiment 1, and hence the description thereof will be omitted.

As shown in FIG. 14, in Embodiment 2, the inclination of the lower guide portion 608 changes before the position at which the insertion of the cartridge B is completed (the position at which the bearing portion 703 comes into contact with the positioning portions), whereby the insertion direction becomes a direction indicated by an arrow C2 at the final stage of the insertion of the cartridge B. In Embodiment 2, the far-side abutment surface 613 and the lower guide portion 608 at the position at which the insertion of the cartridge B is completed function as the positioning portions.

The first direction perpendicular to the far-side abutment surface 613 serving as the positioning portion and the second direction perpendicular to the lower guide portion 608 serving as the positioning portion intersect the insertion direction C in which the cartridge B is inserted into the apparatus main body 100. In addition, in the state in which the bearing portion 703 is in contact with the positioning portions, the transfer pressing force T is parallel to the second direction (perpendicular to the lower guide portion 608). Further, the transfer pressing force T is perpendicular to the first direction (parallel to the far-side abutment surface 613).

In Embodiment 2, in the state in which the bearing portion 703 is in contact with the positioning portions, the transfer pressing force T which acts on the photosensitive drum 302 from the transfer roller 303 does not have the component force T1 in the first direction (the direction perpendicular to the far-side abutment surface 613) (T1=0). Accordingly, in the state in which the bearing portion 703 is in contact with the positioning portions, the cartridge B does not receives a force which pushes back the cartridge B in a direction opposite to the insertion direction C2. Consequently, in the state in which the bearing portion 703 is in contact with the positioning portions, the magnitude of the component force P1 with which the pressing member L605 presses the bearing portion 703 against the positioning portion in the first direction (the direction perpendicular to the far-side abutment surface 613) can be set to any magnitude which is more than zero.

In the case of Embodiment 1, the transfer pressing force T has the component force T1 in the first direction, and the direction thereof is opposite to the direction in which the bearing portion 703 is pressed against the positioning portion. Consequently, the magnitude of the component force P1 of the holding and pressing force in the direction in which the bearing portion 703 is pressed against the positioning portion needs to be larger than the magnitude of the component force T1 in the first direction of the transfer pressing force T but, in Embodiment 2, such a condition does not need to be satisfied. Therefore, it is possible to further reduce the urging force P generated by the urging portion 611 serving as the source of the holding and pressing force of the pressing member L605, and it is possible to further reduce the resistance force derived from the pressing member L605 which the cartridge B receives when the cartridge B is inserted. With this, operability when the cartridge B is attached and detached is further improved and, it is not necessary to reduce the transfer pressing force T, and hence it is possible to maintain the quality of image formation.

Embodiment 3

Figure 16:
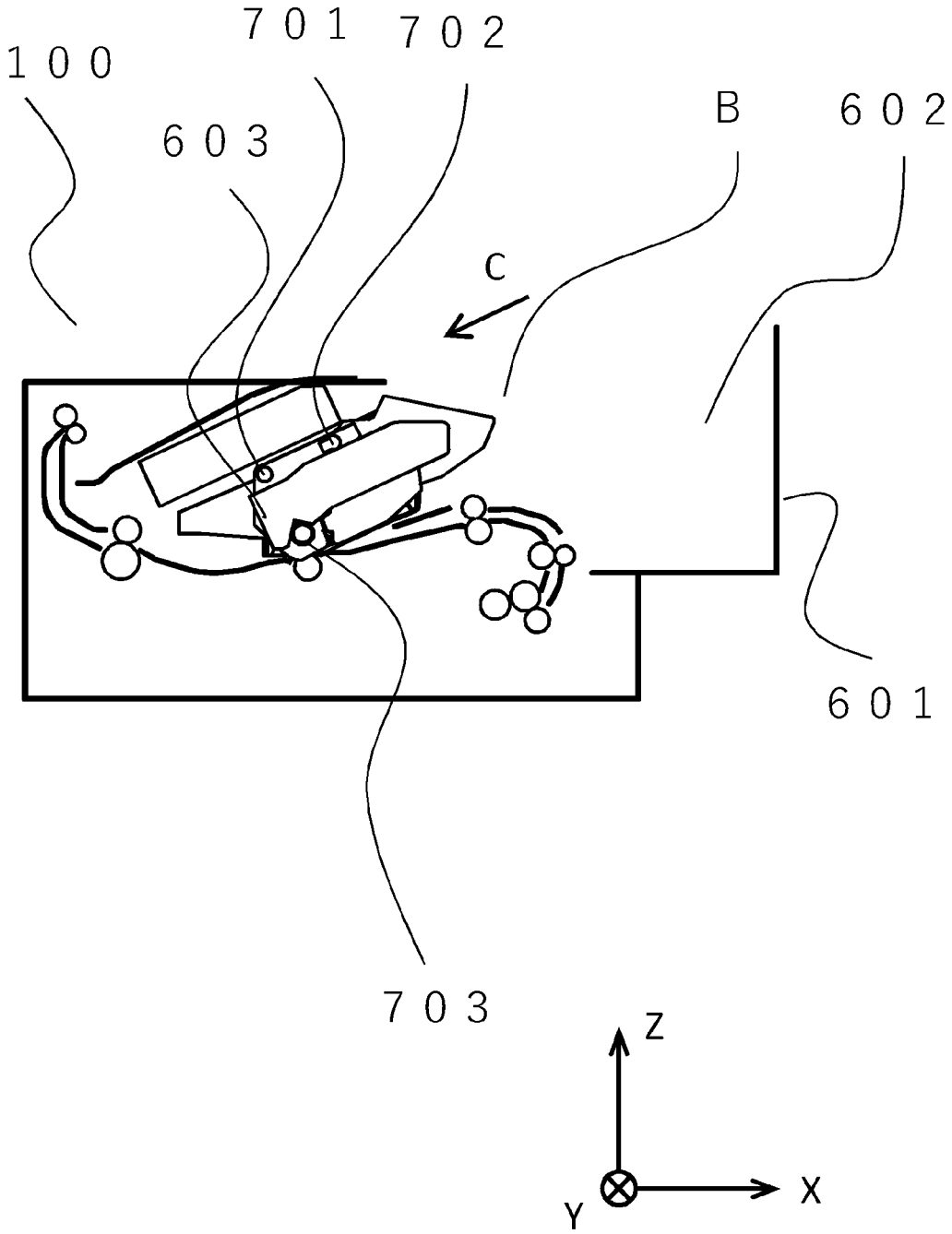
FIG. 16 is a view showing a state in which insertion of the cartridge in Embodiment 3 is completed.
Figure 17:
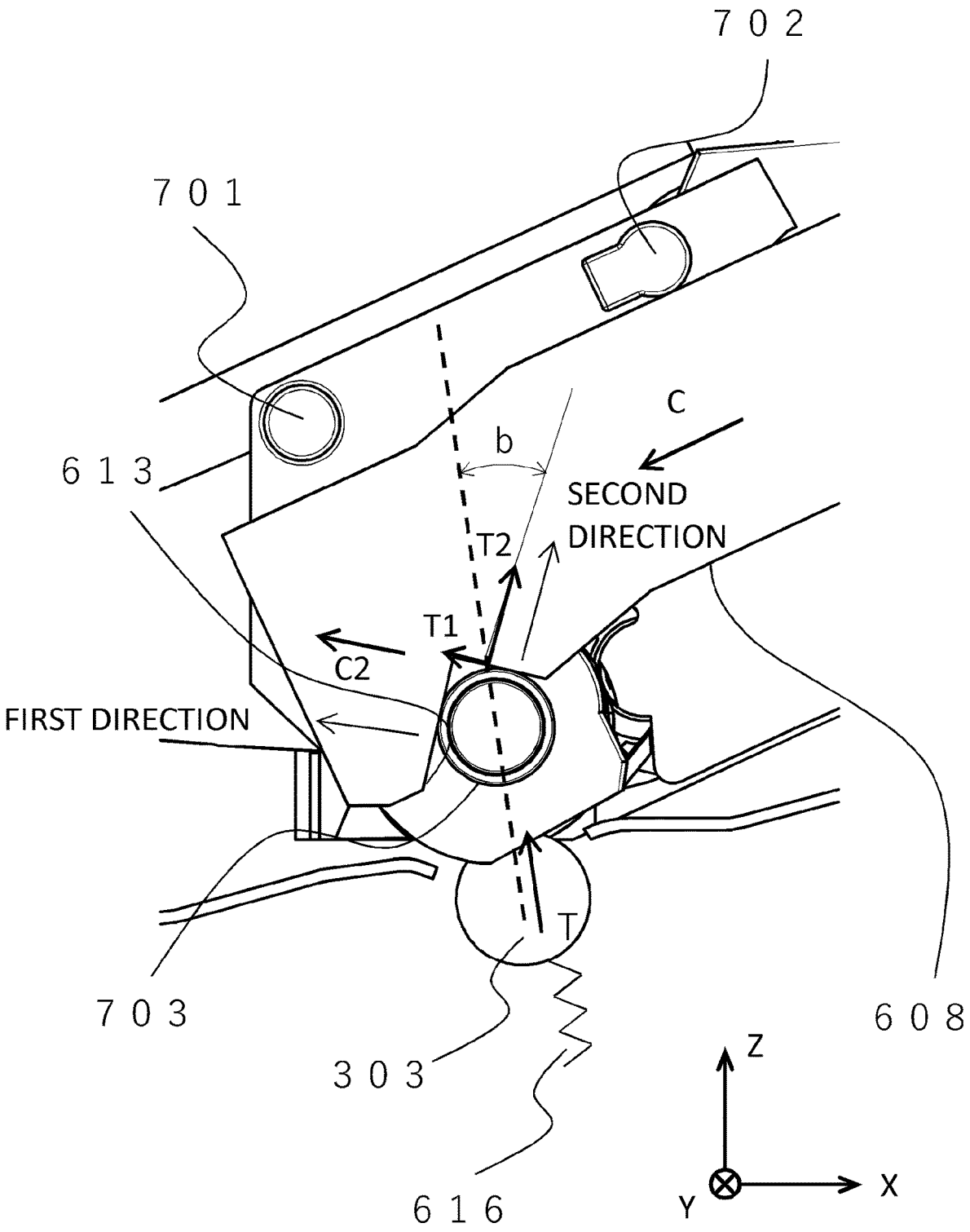
FIG. 17 is an enlarged view of the surrounding portion of the bearing portion in the state in which the insertion of the cartridge in Embodiment 3 is completed.

Embodiment 3 according to the present invention will be described. FIG. 16 is a view showing a state in which the insertion of the cartridge B according to Embodiment 3 is completed. In addition, FIG. 17 is an enlarged view of the surrounding portion of the bearing portion 703 in the state in FIG. 16. Note that the overall configuration of the image forming apparatus, the image forming process, and operations of individual portions performed until the insertion of the cartridge B is completed are the same as those in Embodiment 1, and hence the description thereof will be omitted.

As shown in FIG. 16, in Embodiment 3, the inclination of the lower guide portion 608 changes before the position at which the insertion of the cartridge B is completed (the position at which the bearing portion 703 comes into contact with the positioning portions), whereby the insertion direction becomes a direction indicated by an arrow C2 at the final stage of the insertion of the cartridge B. In Embodiment 3, the far-side abutment surface 613 and the lower guide portion 608 at the position at which the insertion of the cartridge B is completed function as the positioning portions.

The first direction perpendicular to the far-side abutment surface 613 serving as the positioning portion and the second direction perpendicular to the lower guide portion 608 serving as the positioning portion intersect the insertion direction C in which the cartridge B is inserted into the apparatus main body 100. In addition, the transfer pressing force T is inclined by an angle b in the insertion direction C with respect to the second direction (the direction perpendicular to the lower guide portion 608). Consequently, in the state in which the bearing portion 703 is in contact with the positioning portions, the transfer pressing force T which acts on the photosensitive drum 302 from the transfer roller 303 has the component force T1 in the first direction (the direction perpendicular to the far-side abutment surface 613), and the direction thereof is a direction in which the bearing portion 703 is pressed against the positioning portion. That is, the transfer pressing force T has the component force T1 in the first direction and the component force T2 in the second direction which act in directions in which the bearing portion 703 is pressed against the positioning portions (the lower guide portion 608 and the far-side abutment surface 613). Accordingly, in the state in which the bearing portion 703 is in contact with the positioning portions, the cartridge B is urged in the same direction as the insertion direction by a force derived from the transfer pressing force T, and is pressed against the positioning portions. Consequently, in the state in which the bearing portion 703 is in contact with the positioning portions, it is possible to set the magnitude of the component force P1 with which the pressing member L605 presses the bearing portion 703 against the positioning portion in the first direction (the direction perpendicular to the far-side abutment surface 613) to zero.

In the case of Embodiment 2, since the transfer pressing force T does not have the component force T1 in the first direction, although the condition related to the magnitude as in Embodiment 1 is not present, the magnitude of the component force P1 in the first direction of the holding and pressing force needs to be larger than zero. In Embodiment 3, the transfer pressing force T has the component force T1 in the first direction and the direction thereof is the direction in which the bearing portion 703 is pressed against the positioning portion, and hence the holding and pressing force which presses the bearing portion 703 against the positioning portion in the first direction becomes unnecessary. Therefore, it is possible to omit the pressing member L605 which is used in Embodiment 1 or Embodiment 2 in order to prevent the position of the center of the photosensitive drum 302 from being displaced by the transfer pressing force. Accordingly, the urging force P generated by the urging portion 611 serving as the source of the holding and pressing force of the pressing member L605 is not present, and hence the resistance force derived from the pressing member L605 which the cartridge B receives when the cartridge B is inserted is not present as well. With this, the operability when the cartridge B is attached and detached is further improved and, it is not necessary to reduce the transfer pressing force T, and hence it is possible to maintain the quality of image formation.

Embodiment 4

Figure 18:
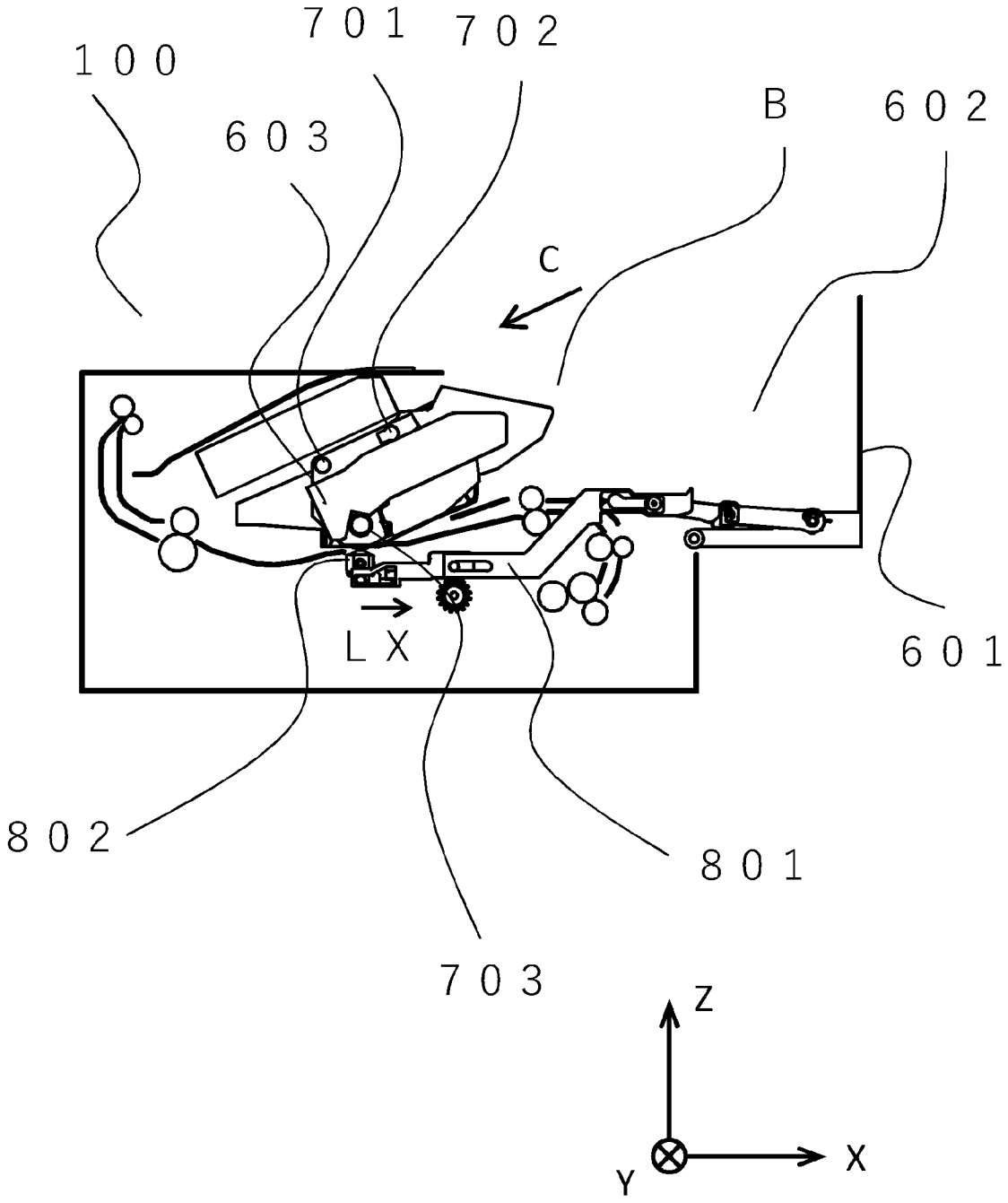
FIG. 18 is a view showing a transfer-separation state when insertion of the cartridge B in Embodiment 4 is completed.
Figure 19:
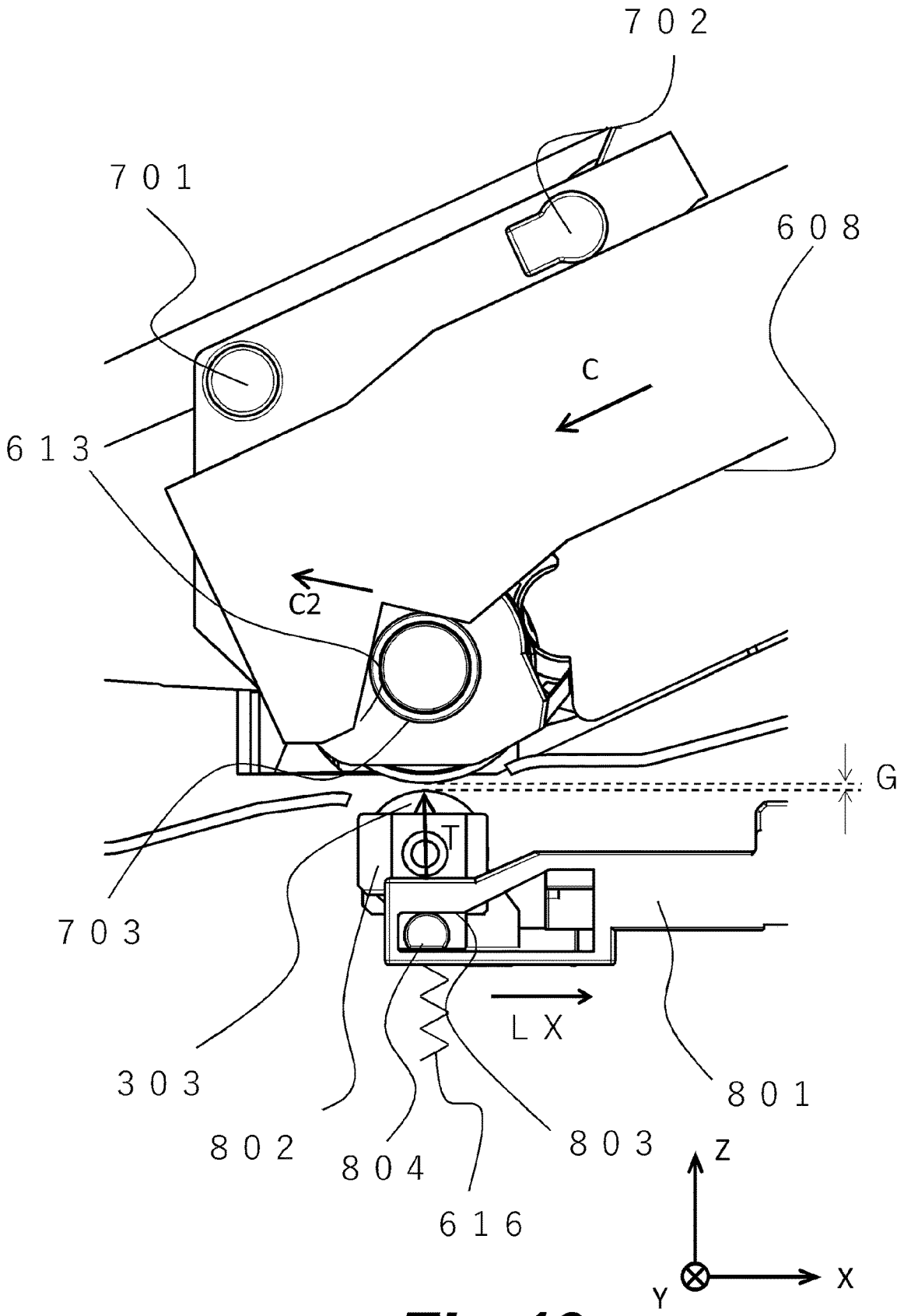
FIG. 19 is an enlarged view of the transfer-separation state in Embodiment 4.
Figure 20:
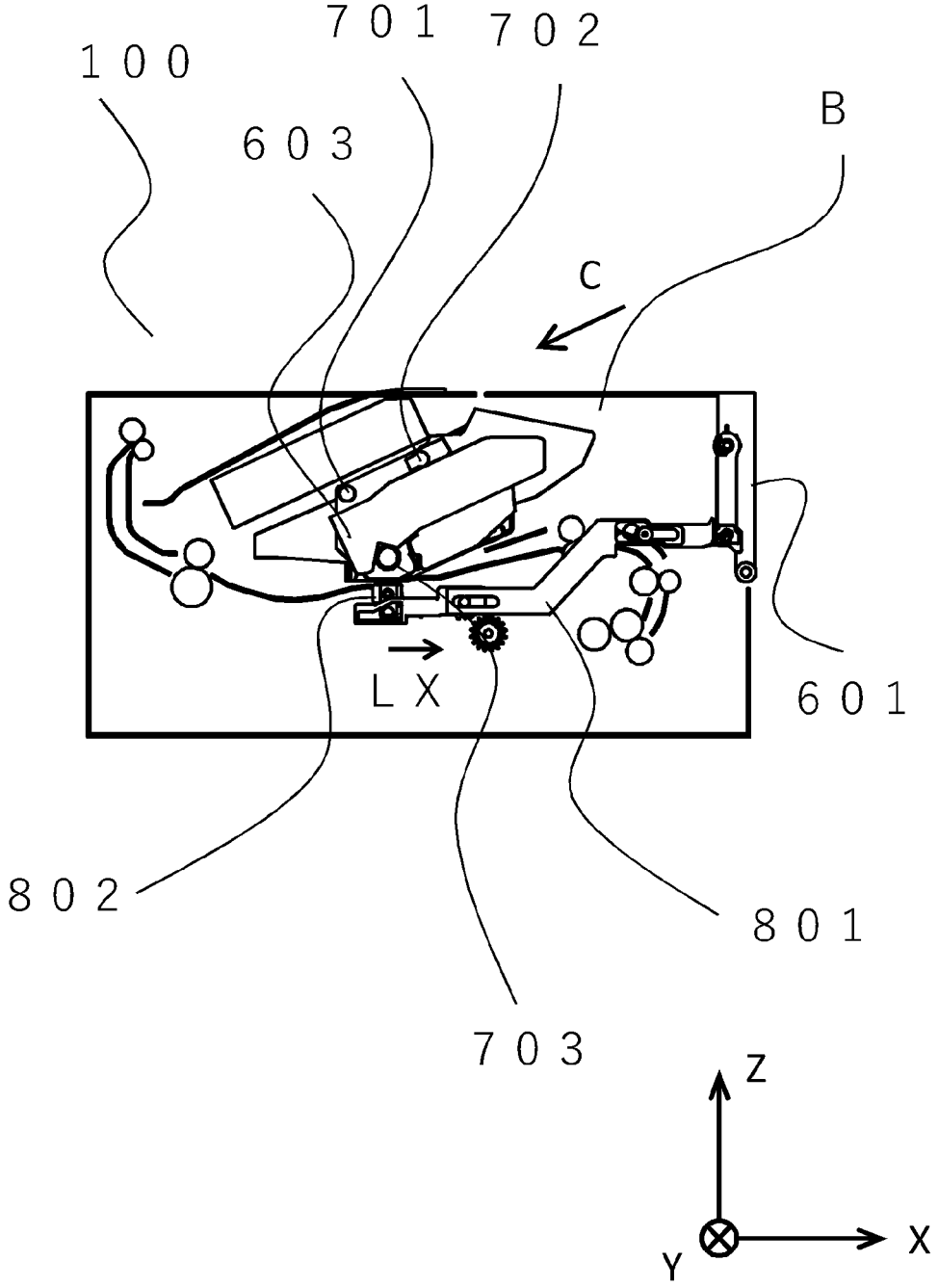
FIG. 20 is a view showing a transfer-contact state when the insertion of the cartridge B in Embodiment 4 is completed.
Figure 21:
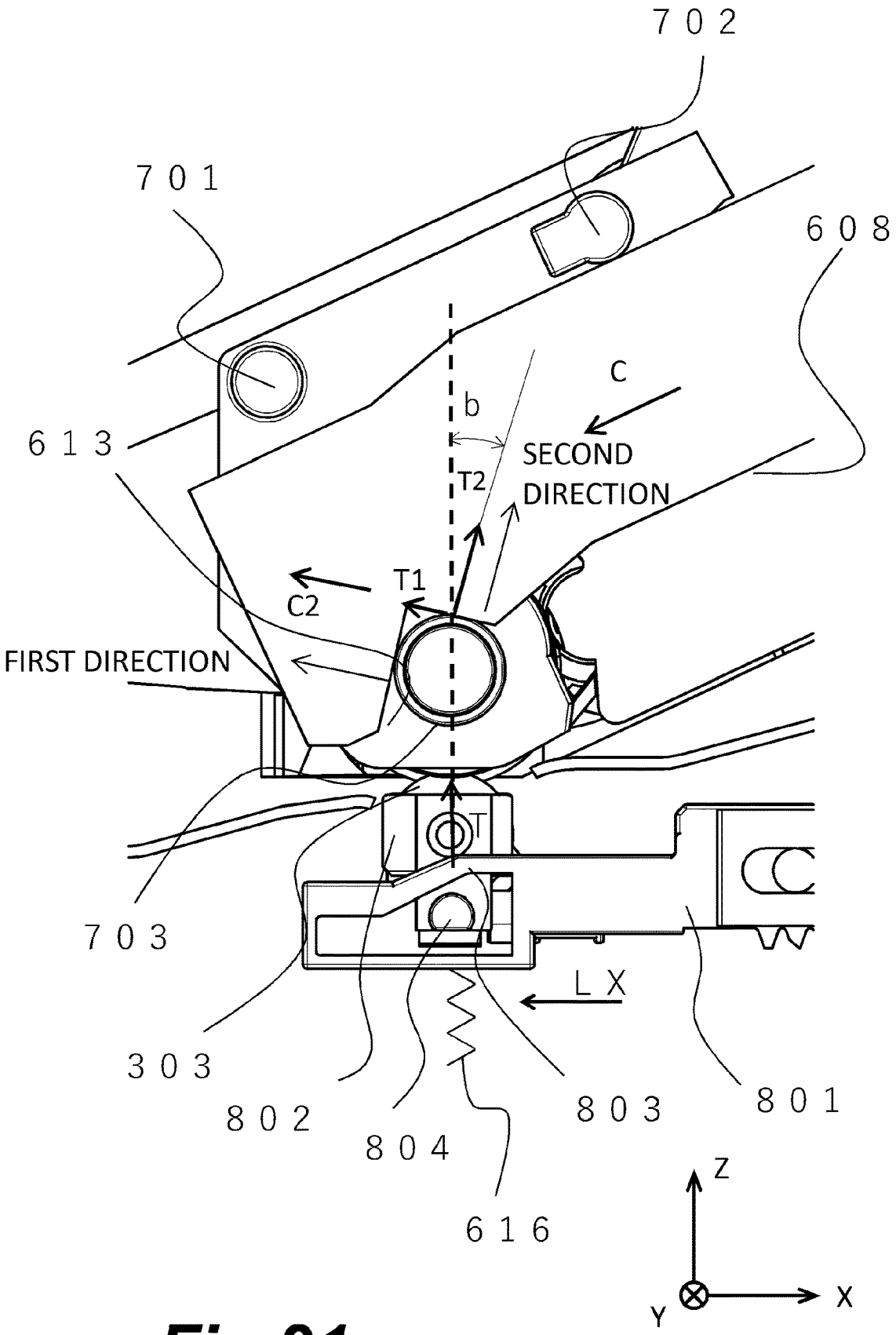
FIG. 21 is an enlarged view of the transfer-contact state in Embodiment 4.

Embodiment 4 according to the present invention will be described. FIG. 18 is a view showing a state in which the insertion of the cartridge B is completed and the transfer roller 303 is at a second position at which the transfer roller 303 is spaced from the photosensitive drum 302. FIG. 19 is an enlarged view of the surrounding portion of the bearing portion 703 in the state in FIG. 18. FIG. 20 is a view showing a state in which the insertion of the cartridge B is completed and the transfer roller 303 is at a first position at which the transfer roller 303 comes into contact with the photosensitive drum 302. FIG. 21 is an enlarged view of the surrounding portion of the bearing portion 703 in the state in FIG. 20. The shape of the guide rail L603 in Embodiment 4 is the same as the shape described in Embodiment 3.

The apparatus main body 100 in Embodiment 4 has a link member 801 coupled to the opening-closing door 601 as a moving mechanism which moves the position of the transfer roller 303 with respect to the photosensitive drum 302. One end of the link member 801 is connected to the opening-closing door 601, and a contact portion 803 is provided at the other end thereof. A transfer roller bearing 802 rotatably holds each of left and right ends of the transfer roller 303 in a longitudinal direction (both ends in a Y direction). A coupling portion 804 is provided in the transfer roller bearing 802, and the coupling portion 804 and the contact portion 803 are brought into contact with each other or are spaced from each other according to the position of the link member 801. The link member 801 moves in a direction parallel to an X direction (indicated by an arrow LX) in response to opening and closing operations of the opening-closing door 601 and, accordingly, the contact portion 803 moves in the X direction in response to the opening and closing operations of the opening-closing door 601.

In the case where the opening-closing door 601 opens the insertion opening 602, as shown in FIG. 19, the link member 801 moves in a +X direction, and the contact portion 803 comes into contact with the coupling portion 804 and presses down the coupling portion 804 in a −Z direction. With this, the transfer roller bearing 802 is pressed down in the −Z direction, and the transfer roller 303 moves to the second position at which the transfer roller 303 is spaced from the photosensitive drum 302. When the transfer roller 303 is at the second position, the transfer roller 303 and the photosensitive drum 302 are brought into a state in which the transfer roller 303 and the photosensitive drum 302 are spaced from each other in a Z direction with a gap G formed therebetween. This state is referred to as a transfer-separation state.

In the case where the opening-closing door 601 closes the insertion opening 602, as shown in FIG. 21, the link member 801 moves in a −X direction, the contact portion 803 and the coupling portion 804 are spaced from each other, and the transfer roller bearing 802 is freed from the link member 801. With this, the transfer roller 303 moves to the first position at which the transfer roller 303 comes into contact with the photosensitive drum 302 with the transfer pressing force T. This state is referred to as a transfer-contact state.

If it is intended that the cartridge B is inserted in the transfer-contact state in which the transfer roller 303 is at the first position, at a stage in which the cartridge B is inserted up to a position before the position at which the bearing portion 703 comes into contact with the positioning portions, the photosensitive drum 302 and the transfer roller 303 start to come into contact with each other. Consequently, in order to insert the cartridge B up to the position at which the bearing portion 703 comes into contact with the positioning portions finally from that stage, it is necessary to press in the cartridge B against the resistance force derived from the transfer pressing force T which pushes back the cartridge B in the direction opposite to the insertion direction C.

However, in Embodiment 4, when the user opens the opening-closing door 601 in order to insert the cartridge B, the transfer roller 303 moves to the second position with the operation of the link member 801, and the transfer-separation state is established. Consequently, in all of the processes of inserting the cartridge B up to the position at which the bearing portion 703 comes into contact with the positioning portions finally, the cartridge B does not receive the resistance force derived from the transfer pressing force T. Accordingly, it becomes possible to improve the operability when the cartridge B is inserted.

After the cartridge B is inserted up to the position at which the bearing portion 703 comes into contact with the positioning portions finally, when the opening-closing door 601 is closed, the transfer roller 303 moves to the first position with the operation of the link member 801, and the transfer-contact state is established. In this state, as described in Embodiment 3, the bearing portion 703 is brought into the state in which the bearing portion 703 is constantly pressed against the lower guide portion 608 and the far-side abutment surface 613 by the component forces T1 and T2 of the transfer pressing force T. Consequently, it is possible to properly maintain the position of the photosensitive drum 302 during an image forming operation without using the pressing member.

Note that, even in the configuration having the pressing member L605 shown in each of Embodiments 1 and 2, by providing the link member 801 identical to that in Embodiment 4, it is possible to reduce the resistance force when the cartridge B is inserted, and it becomes possible to further improve the operability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-172251, filed on Oct. 21, 2021, which is hereby incorporated by reference herein in its entirety.

What is claimed is:

1. An image forming apparatus comprising:

a cartridge having a photosensitive drum; and an apparatus main body to and from which the cartridge is attachable and detachable, wherein the apparatus main body includes:

a transfer roller configured to form a transfer nip by exerting a transfer pressing force on the photosensitive drum in a state the cartridge is attached to the apparatus main body;

a positioning portion configured to position the photosensitive drum in a first direction and a second direction by being contacted by a bearing portion which is holding a rotation axis of the photosensitive drum, the first direction being in a virtual plane perpendicular to the rotation axis, and the second direction being a direction which intersects the first direction; and a pressing member configured to exert a holding and pressing force which presses the bearing portion toward the positioning portion, and, in a state in which the bearing portion is in contact with the positioning portion, the holding and pressing force has a component force in the first direction, and the transfer pressing force has a component force in the second direction that is oriented to press the bearing portion toward the positioning portion.

2. The image forming apparatus according to claim 1, wherein, in the state in which the bearing portion is in contact with the positioning portion, the transfer pressing force has a component force in the first direction that is oriented opposite to a direction of pressing the bearing portion toward the positioning portion, and magnitude of the component force in the first direction of the holding and pressing force is larger than magnitude of the component force in the first direction of the transfer pressing force.

3. The image forming apparatus according to claim 1, wherein, in the state in which the bearing portion is in contact with the positioning portion, the transfer pressing force is parallel to the second direction.

4. The image forming apparatus according to claim 1, wherein the pressing member includes:

a rotation portion configured to rotate in the virtual plane perpendicular to the rotation axis of the photosensitive drum; and an urging portion configured to urge the rotation portion, the rotation portion has a first inclined surface configured to come into contact with the bearing portion so as to hold the bearing portion between the positioning portion and the first inclined surface in the state in which the bearing portion is in contact with the positioning portion, and an urging force of the urging portion is configured to act on the bearing portion via the first inclined surface and the holding and pressing force is thereby caused to act.

5. The image forming apparatus according to claim 4, wherein the rotation portion has a second inclined surface connected to an end portion of the first inclined surface and a top portion which extends along a line of intersection of the first inclined surface and the second inclined surface, a direction perpendicular to the second inclined surface has a component in an insertion direction of the cartridge that is oriented opposite to the insertion direction, and, in a process of inserting the cartridge, the bearing portion is configured to come into contact with the second inclined surface, get over the top portion while rotating the rotation portion against the urging force of the urging portion via the second inclined surface in a state in which the bearing portion is in contact with the second inclined surface, come into contact with the first inclined surface, and reach the positioning portion while being urged by the urging portion via the first inclined surface in a state in which the bearing portion is in contact with the first inclined surface.

6. The image forming apparatus according to claim 1, wherein the apparatus main body includes:

an opening for inserting or taking the cartridge;

a door configured to open and close the opening; and a moving mechanism configured to move the transfer roller to a first position at which the transfer roller comes into contact with the photosensitive drum in a case where the door closes the opening, and move the transfer roller to a second position at which the transfer roller is spaced from the photosensitive drum in a case where the door opens the opening.

7. The image forming apparatus according to claim 1, wherein the first direction is parallel to a direction in which the cartridge is inserted into the apparatus main body.

8. The image forming apparatus according to claim 1, wherein the first direction and the second direction intersect a direction in which the cartridge is inserted into the apparatus main body.

9. The image forming apparatus according to claim 1, wherein the transfer pressing force has a vertical upward component, and the second direction has a vertical upward component.

10. The image forming apparatus according to claim 1, wherein the positioning portion is part of a guide rail configured to guide the cartridge when the cartridge is attached to and detached from the apparatus main body.

11. An image forming apparatus comprising:

a cartridge having a photosensitive drum; and an apparatus main body to and from which the cartridge is attachable and detachable, wherein the apparatus main body includes:

a transfer roller configured to form a transfer nip by exerting a transfer pressing force on the photosensitive drum in a state the cartridge is attached to the apparatus main body; and a positioning portion configured to position the photosensitive drum in a first direction and a second direction by being contacted by a bearing portion which is holding a rotation axis of the photosensitive drum, the first direction being in a virtual plane perpendicular to the rotation axis, and the second direction being a direction which intersects the first direction, and, in a state in which the bearing portion is in contact with the positioning portion, the transfer pressing force has a component force in the first direction and a component force in the second direction, and each of the component forces is oriented to press the bearing portion toward the positioning portion.

12. The image forming apparatus according to claim 11, wherein the apparatus main body includes:

an opening for inserting or taking the cartridge;

a door configured to open and close the opening; and a moving mechanism configured to move the transfer roller to a first position at which the transfer roller comes into contact with the photosensitive drum in a case where the door closes the opening, and move the transfer roller to a second position at which the transfer roller is spaced from the photosensitive drum in a case where the door opens the opening.

13. The image forming apparatus according to claim 11, wherein the first direction is parallel to a direction in which the cartridge is inserted into the apparatus main body.

14. The image forming apparatus according to claim 11, wherein the first direction and the second direction intersect a direction in which the cartridge is inserted into the apparatus main body.

15. The image forming apparatus according to claim 11, wherein the transfer pressing force has a vertical upward component, and the second direction has a vertical upward component.

16. The image forming apparatus according to claim 11, wherein the positioning portion is part of a guide rail configured to guide the cartridge when the cartridge is attached to and detached from the apparatus main body.

* * * * *